US005816368A

United States Patent [19]

Barrett et al.

[11] Patent Number: 5,816,368

[45] Date of Patent: Oct. 6, 1998

[54] ELEVATOR CARS SWITCH HOISTWAYS WHILE TRAVELING VERTICALLY

[75] Inventors: David W. Barrett, East Hartland; John F. Cassidy, Jr., Avon; George A. L. David, West Hartford; Ernest P. Gagnon, Manchester; Andrew F. Peruggi; Richard E. Peruggi, both of Glastonbury, all of Conn.

[73] Assignee: Otis Elevator Company, Farmington, Conn.

[21] Appl. No.: 821,752

[22] Filed: Mar. 20, 1997

[51] Int. Cl.[6] ..... B66B 1/06; B66B 1/00; B66B 9/00

[52] U.S. Cl. ..... 187/289; 187/277; 187/249

[58] Field of Search ..... 181/401, 411, 181/414, 269, 277, 249

[56] References Cited

U.S. PATENT DOCUMENTS

| | | | |
|---|---|---|---|
| 1,939,729 | 12/1933 | Stark | 187/249 |
| 3,750,849 | 8/1973 | Berkovitz | 187/249 |
| 3,896,736 | 7/1975 | Hamy | 187/249 |
| 5,651,426 | 7/1997 | Bittar et al. | 187/249 |
| 5,660,249 | 8/1997 | Powell et al. | 187/249 |

FOREIGN PATENT DOCUMENTS

| | | | |
|---|---|---|---|
| 3-177293 | 8/1991 | Japan . | |
| 3-279186 | 12/1991 | Japan | 187/289 |
| 4-341479 | 11/1992 | Japan . | |
| 6-9175 | 1/1994 | Japan | 187/289 |
| 9-30756 | 2/1997 | Japan . | |

*Primary Examiner*—Robert Nappi

[57] ABSTRACT

Each of a pair of vertically and horizontally adjacent hoistways has an elevator car coupler roped through a traction machine to a counterweight so as to be able to raise and lower the elevator car within the related hoistway. A transition section joins the upper end of the lower hoistway with the lower end of the upper hoistway. A pair of guide rails are disposed on each side of the elevator system, including the upper hoistway, the transition section and the lower hoistway. Elevator cars are guided from the top of the upper hoistway to the bottom of the lower hoistway and/or vice versa by one of the pairs of rails. Power in the transition section is provided by a pair of LEMs, one on each side of the hoistways.

8 Claims, 20 Drawing Sheets

FIG. 12
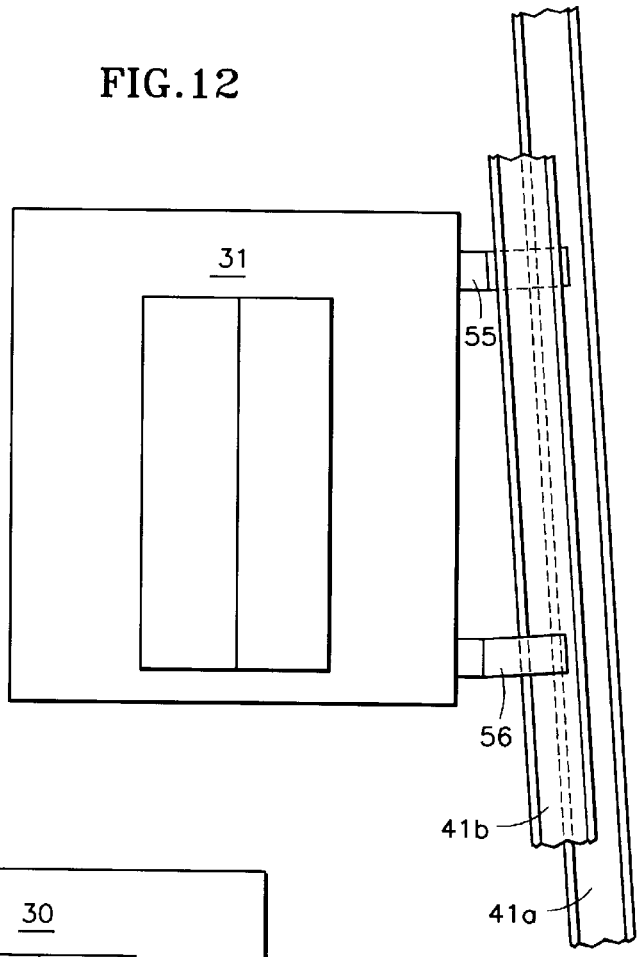
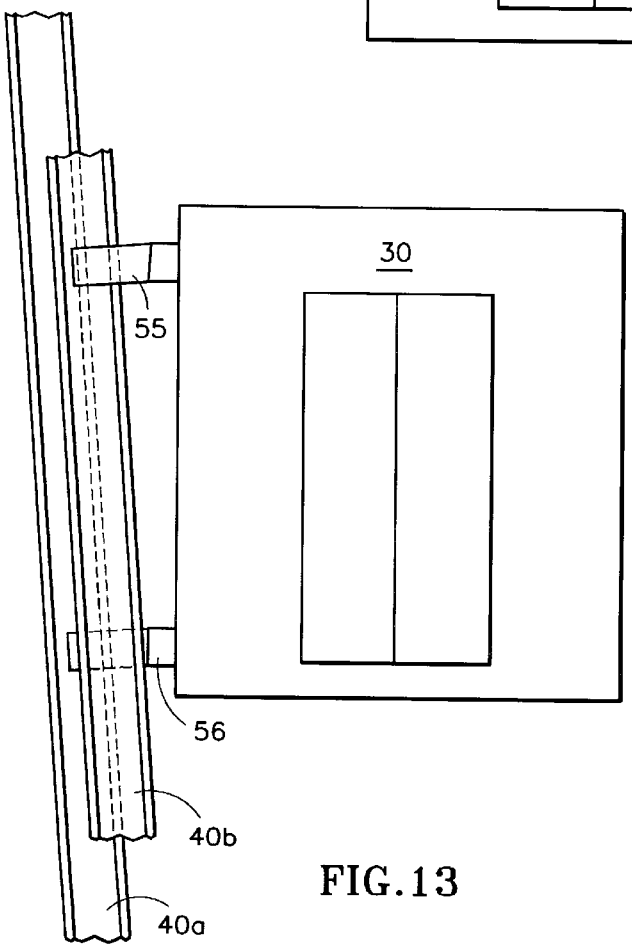
FIG. 13

FIG.24
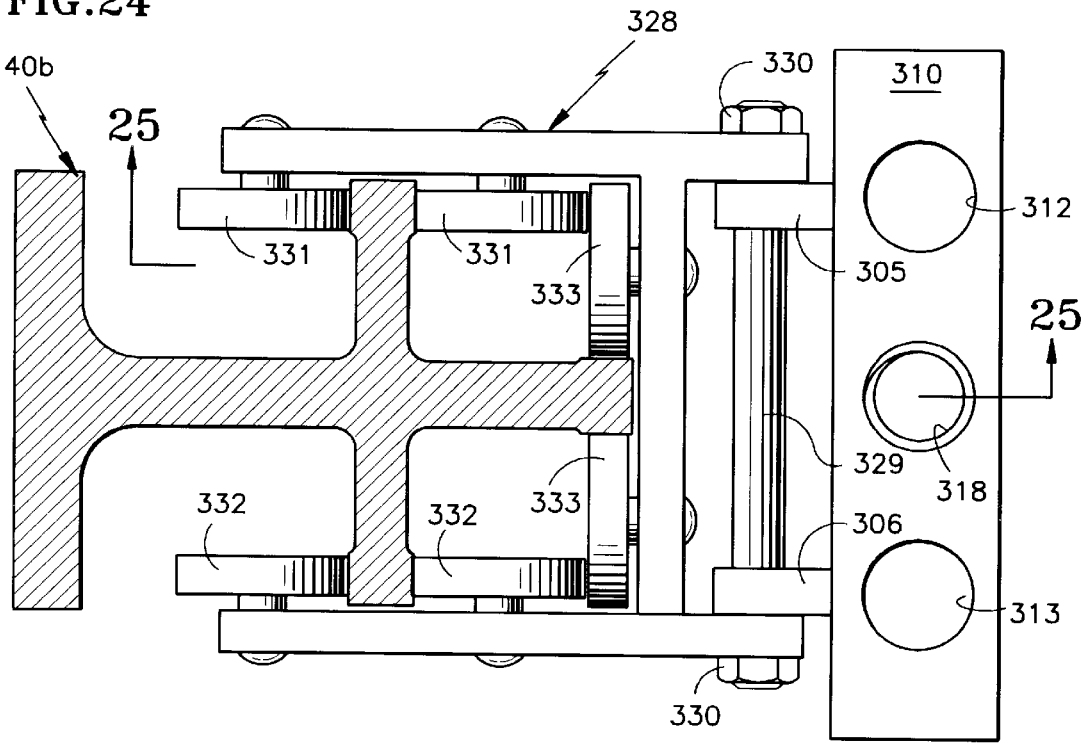
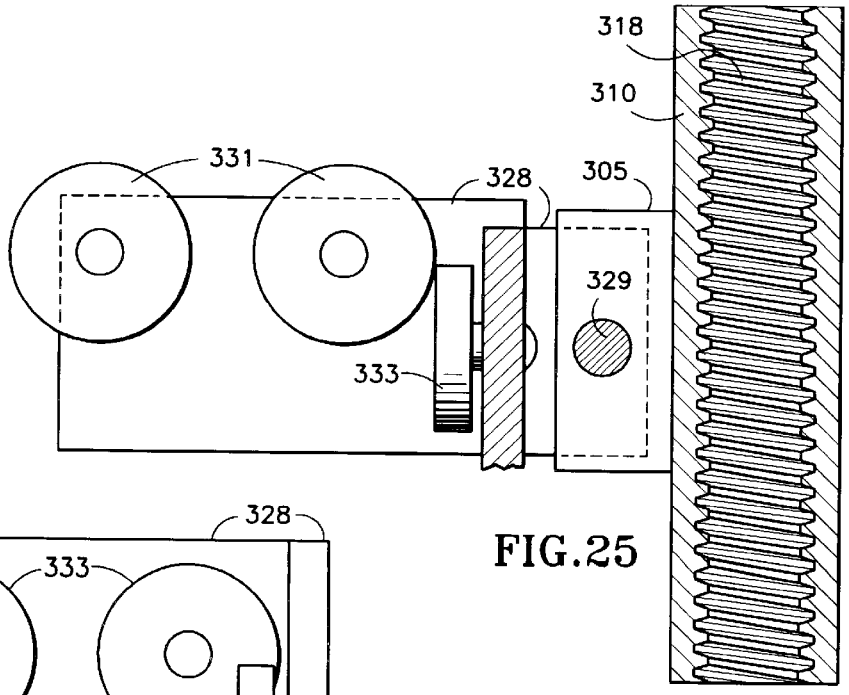
FIG.25
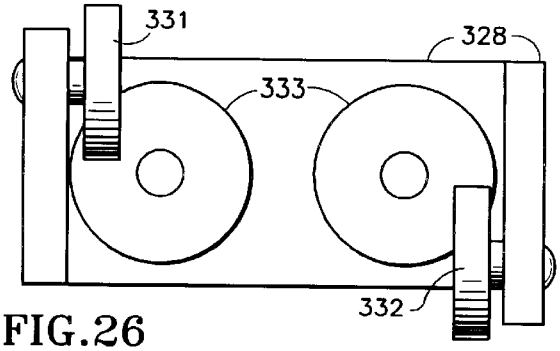
FIG.26

FIG.27
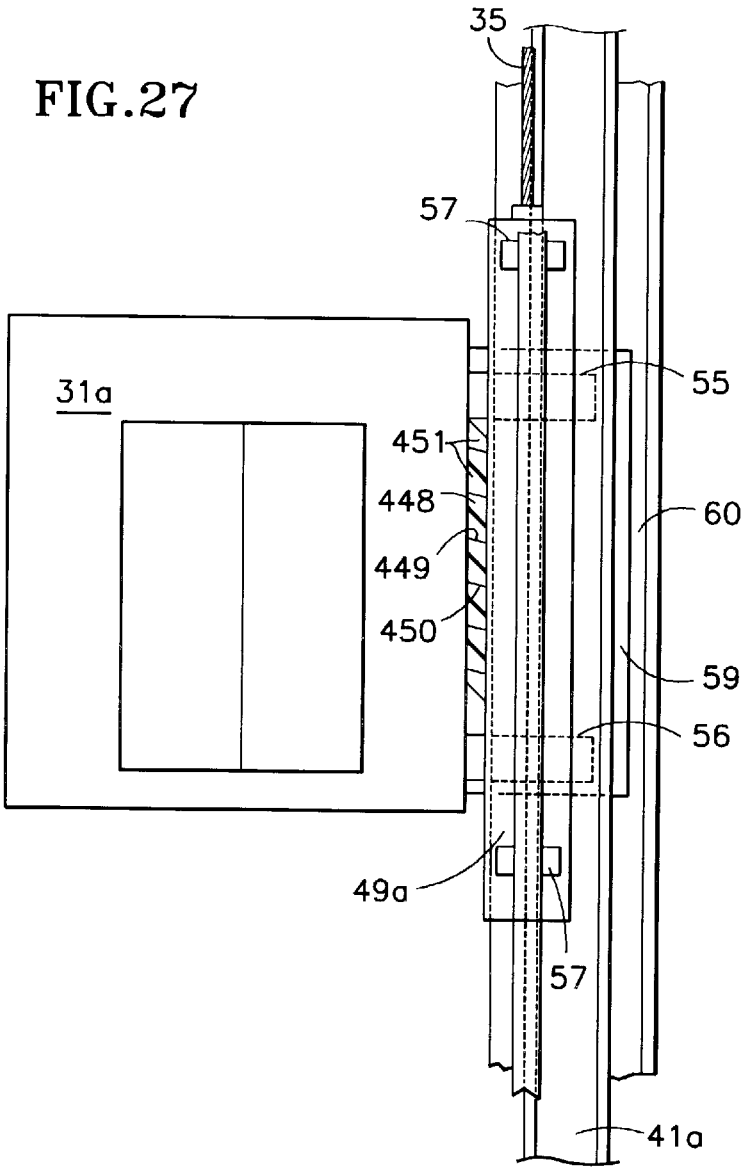
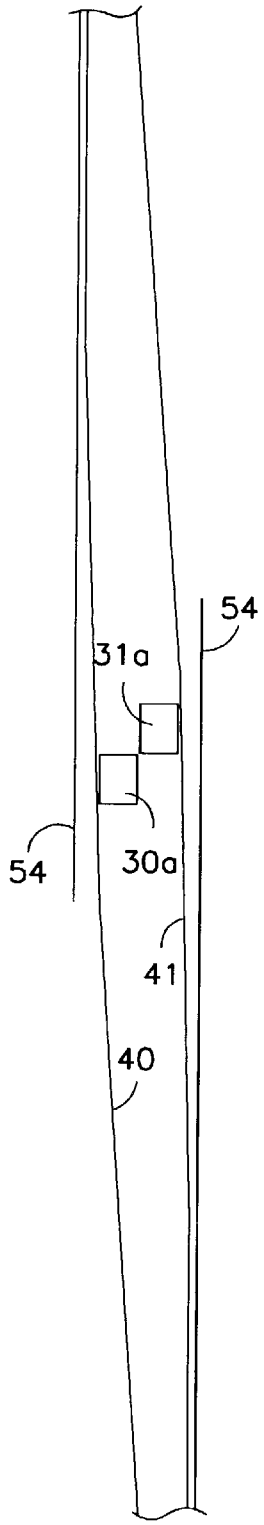
FIG.30

ELEVATOR CARS SWITCH HOISTWAYS WHILE TRAVELING VERTICALLY

TECHNICAL FIELD

This invention relates to an elevator for a hypertall building in which elevator cars are moved from one hoistway to another hoistway while traveling vertically by an inter-hoistway transition section, such as might be powered by a linear electric motor.

BACKGROUND ART

In hypertall buildings, it has been known to move passengers to the highest parts of the building by means of a series of elevators, the lower elevator taking the passengers to a first sky lobby, after which the passengers walk to another elevator for travel to a second sky lobby; thereafter, passengers may disperse in local elevators or travel in yet a third elevator to an additional sky lobby. The taller a building becomes, the more difficult it is to find sufficient space for elevators to move the requisite number of passengers to the higher ends of the building. Thus, it becomes more important with additional height that the use of the elevator core space be very efficient.

Another problem with hypertall buildings is that the weight of the elevator rope (the steel cables that support the car and the counterweight) preclude use of rope systems beyond about one hundred twenty floors, or so. Another problem with conventional elevators is that only one elevator can occupy an elevator hoistway at a time since it must be continuously roped to its counterweight, and since it reciprocates, up and down, in the hoistway.

It is suggested to overcome some of these problems by the use of elevators powered by linear electric motors (LEMs), which provide driving force to the elevator car directly from the building structure. However, without a counterweight, the size and power requirements currently required for LEMs suitable to move elevator cars detract from the use of LEMs for elevator service serving hundreds of floors.

In copending U.S. patent application Ser. No. 8/564,754, filed Nov. 29, 1995, an elevator cab travels in a car frame in one hoistway to a transfer floor where the car frame stops; the cab is moved to a car frame in an adjacent hoistway for further travel.

DISCLOSURE OF INVENTION

Objects of the present invention include eliminating the need to limit the height of elevator service as a consequence of elevator support rope weight, providing a readily achievable elevator system in which more than one elevator car can travel in a hoistway core space at a given time, and provision of an improved, highly effective elevator system for hypertall buildings. Another object is to eliminate the need to decelerate to a stop for transferring a cab between hoistways during an elevator run.

According to the present invention, a plurality of vertically and horizontally adjacent hoistways between service levels of a building each have car couplers for selectively coupling a counterweighted rope to a car. Each counterweight moves in alternate down and up directions, first coupled to a car heading up, and then coupled to a car heading down, to advance successive cars coupled thereto in alternate up and down directions in synchronism with the movement of a car coupled to the coupler of an adjacent hoistway. A transition section, centered near where the hoistways overlap, takes each car from one hoistway and moves it vertically and laterally and delivers it into another hoistway, whereby the cars change hoistways without the requirement of stopping before the change is made. There are two sets of elevator car guide rails, one on one side of the hoistway and the other on the other side of the hoistway. In one embodiment, the cars go up on one set of rails and go down on the other set of rails; in another embodiment, a car may go up and down on the same set of rails.

The transition section may comprise a linear electric motor (LEM) which extends from one side of the high end of the low hoistway of a pair to the same side of the low end of the high hoistway of the pair, and another LEM which extends from the other side of the low end of the high hoistway of the pair to the same other side of the high end of the low hoistway of the pair. Since the cars are guided by their own rails, the LEM need only supply vertical support and motion control to the cars. In one embodiment, the car coupler in each hoistway includes a pair of fork-lift-like portions which extend partway out into the hoistway under the car. In another embodiment, tooth-like couplers are utilized on the sides of the cars. In the first embodiment, the cars must be removed from the hoistway at the top and bottom landings and turned around, with all cars traveling up on one pair of guide rails and all cars traveling down on the other pair of guide rails. In a second embodiment, the cars need not leave the hoistway and each car travels up on the same set of rails as it travels down on. However, for off-hoistway loading and unloading, the cars typically will be removed from the hoistway for unloading simultaneously with a loaded car being returned to the hoistway.

Other objects, features and advantages of the present invention will become more apparent in the light of the following detailed description of exemplary embodiments thereof, as illustrated in the accompanying drawing.

BRIEF DESCRIPTION OF THE DRAWINGS

FIG. 12 is a partial, side elevation view of an elevator car, guide rails and roller guides transitioning from one hoistway to another on the right hand guide rails of FIG. 1.

FIG. 13 is a partial, side elevation view of an elevator car, guide rails and roller guides transitioning from one hoistway to another on the left hand guide rails of FIG. 1.

FIG. 24 is a top plan view of a portion of the releasable, self-tilting roller guide assembly.

FIG. 25 is a sectional view taken on the line 25—25 in FIG. 24.

FIG. 26 is a front elevation view of the assembly of FIGS. 24 and 25.

FIG. 27 is a partially stylized, side elevation view of an elevator car with an alternative form of coupler.

FIG. 30 is a simplified, stylized, side elevation view of an elevator system employing couplers of the type shown in FIGS. 27–29.

BEST MODE FOR CARRYING OUT THE INVENTION

Figure 1:
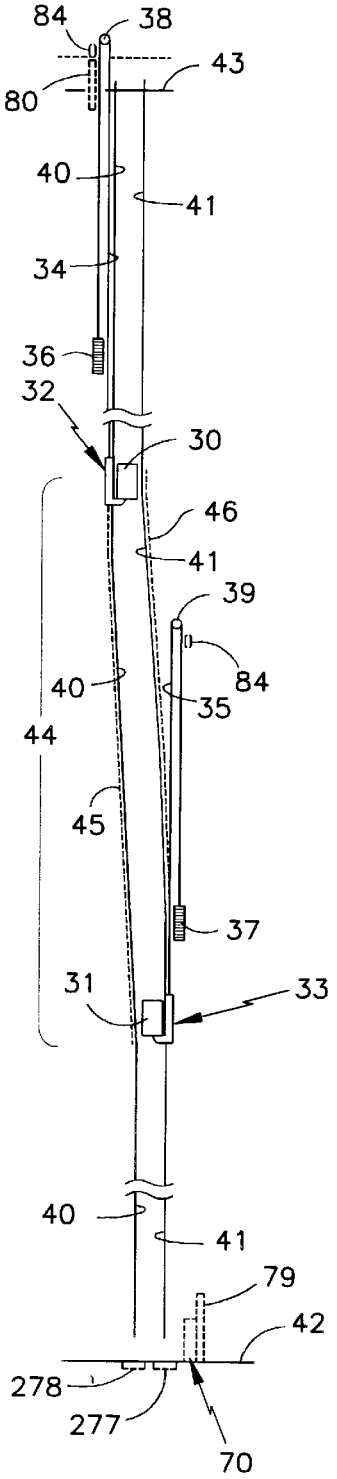
FIG. 1 is a simplified, stylized, side elevation view of an elevator system incorporating the present invention.

Referring now to FIG. 1, a pair of elevator cars 30, 31 are each engaged by a coupler 32, 33 which are raised and lowered by means of a rope 34, 35 connected to a counterweight 36, 37 and driven by a traction machine 38, 39. Each car 30, 31 is guided by its own pair of rails 40, 41 (only one rail per car being shown in FIG. 1). The rails 40, 41 extend from just above a lower landing 42 to just above an upper landing 43. Approximately midway between the landings, the rails 40, 41 curve to move the car from the hoistway of one coupler 32, 33 to the hoistway of the other coupler 33, 32, within a transition section 44 which includes a linear electric motor (LEM) primary 45, 46 (represented by the dashed lines in FIG. 1) for supporting and propelling each of the cars. When the cars are brought into the transition section by the couplers 32, 33 (approximately as shown in FIG. 1) LEM secondaries on the cars interact with the LEM primaries 45, 46 to propel the cars. Each car can disengage from the coupler and be moved in the transition section by its LEM toward the other coupler, as it continues its downward or upward trip. In the embodiment of FIG. 1, cars travel downwardly on the right hand rails 40 and travel upwardly on the left had rails 41, in the manner which is described more fully hereinafter.

Figure 2:
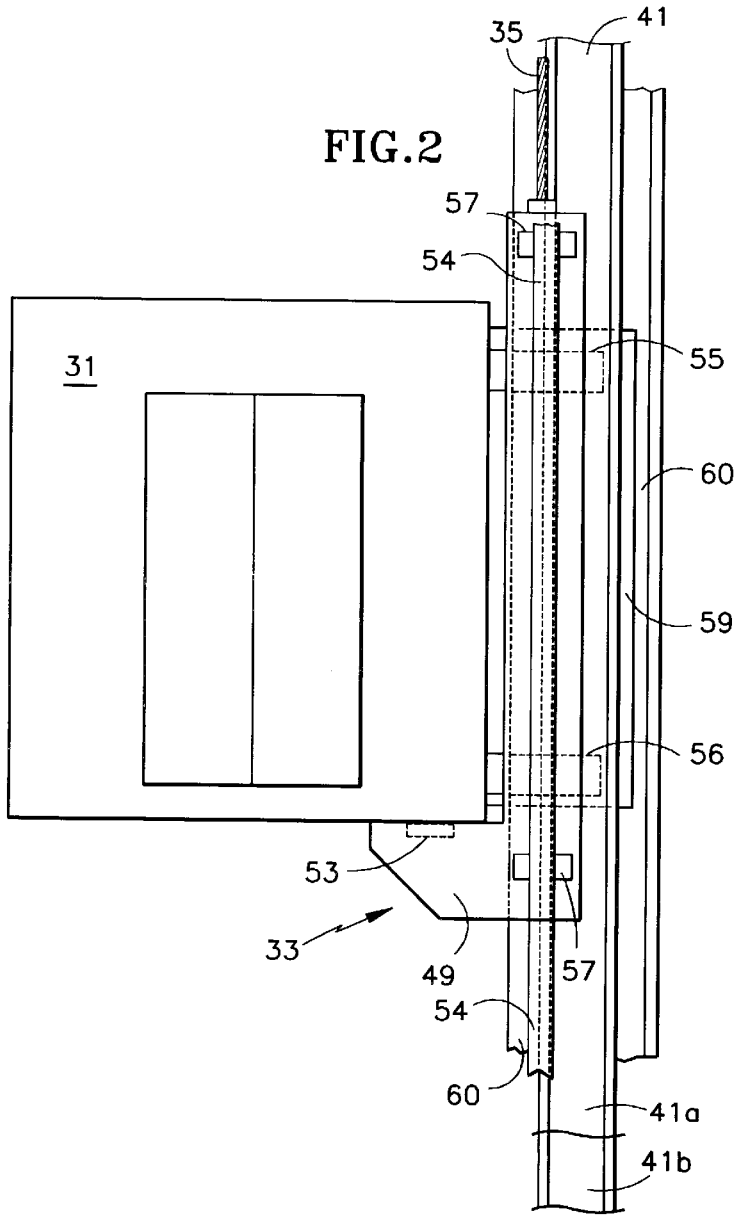
FIG. 2 is a simplified, side elevation view of an elevator car, coupler and rails in the embodiment of FIG. 1.
Figure 3:
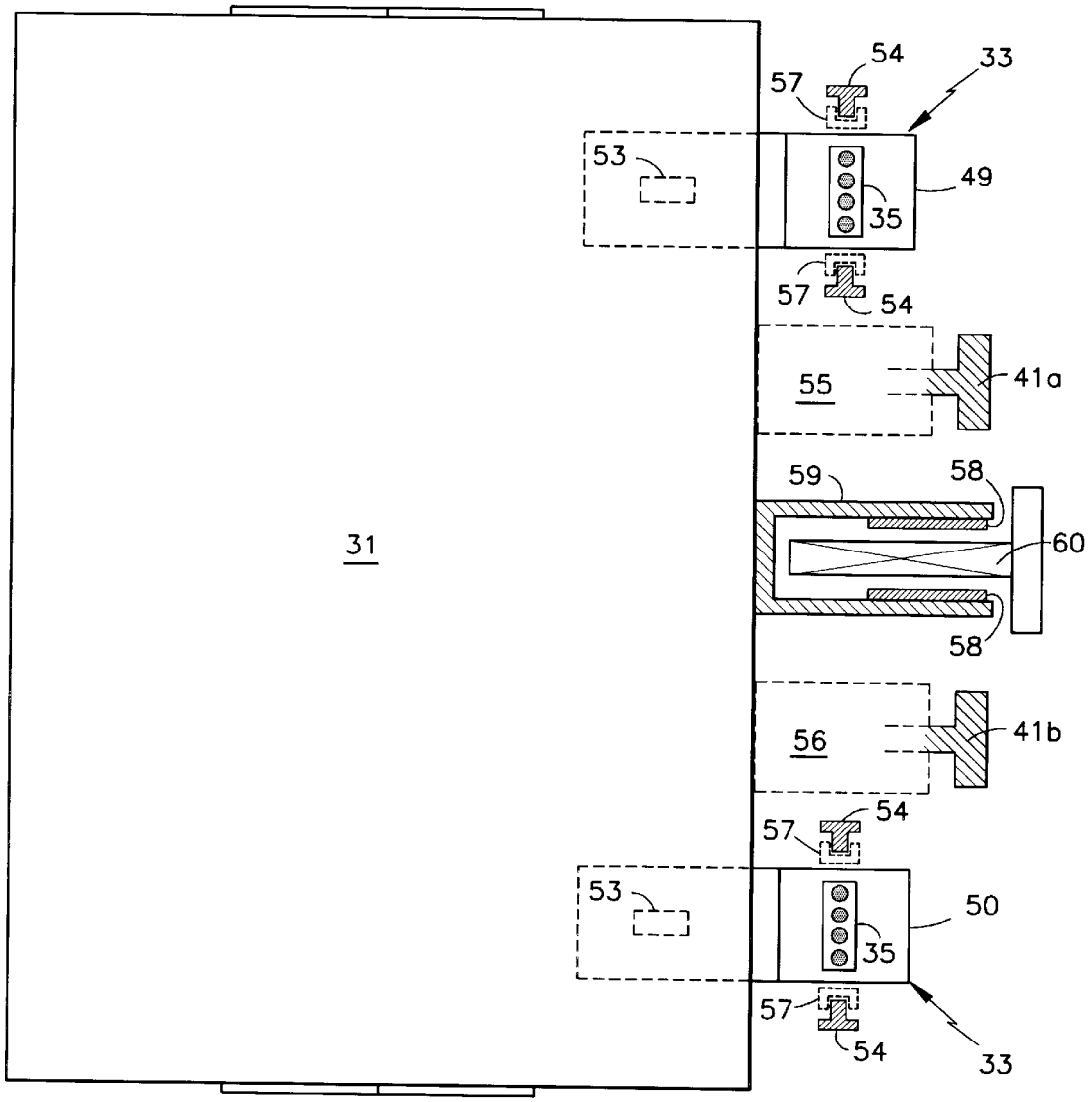
FIG. 3 is a partially sectioned, stylized, top plan view of the apparatus of FIG. 2.
Figure 4:
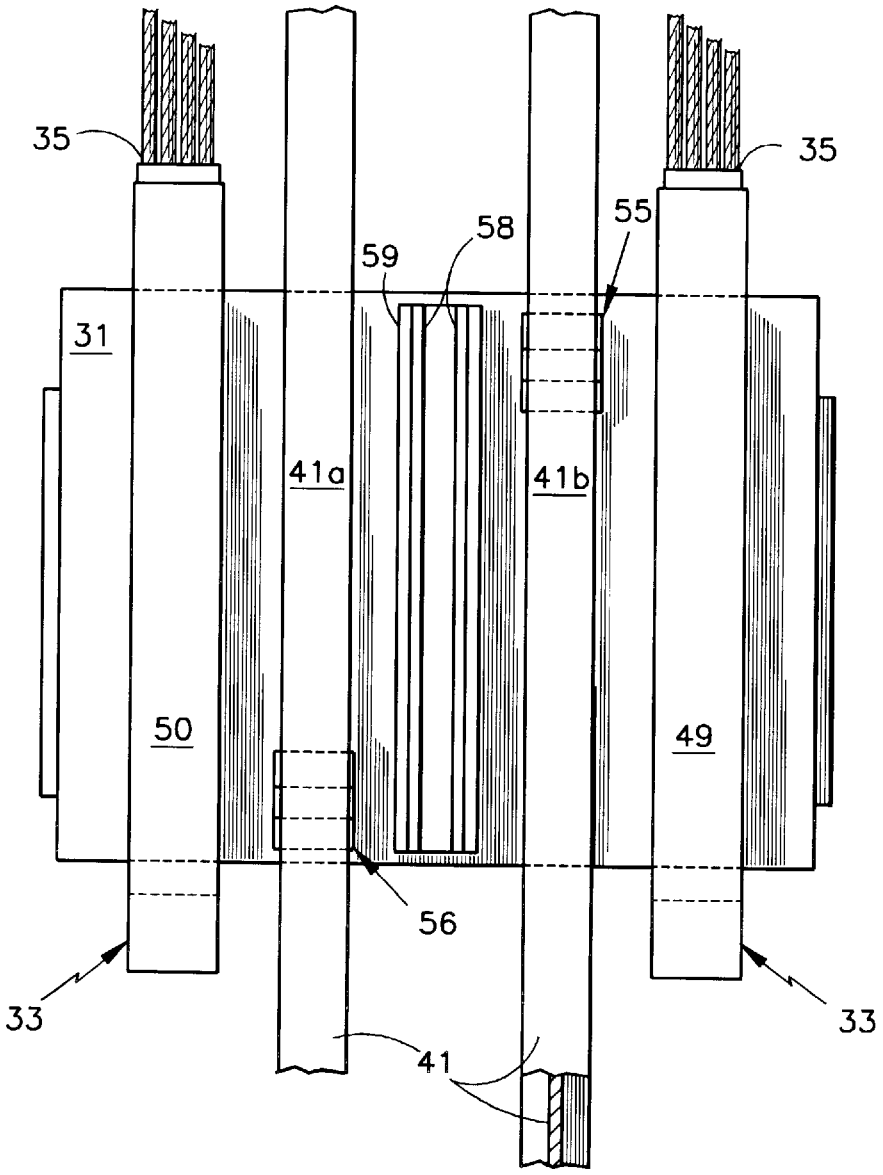
FIG. 4 is a stylized rear view of the apparatus of FIGS. 2 and 3.

The nature of the couplers 32, 33 is described with respect to coupler 33 in FIGS. 2–4. Each coupler 33 actually comprises two parts 49, 50 each having its own rope 35, which in this embodiment is shown to be four conventional stranded steel cables for each portion 49, 50. If desired, the cab 31 may be secured to the coupler 33 by means of locks 53 (shown only in FIGS. 2 and 3), such as the cab/car locks disclosed in copending U.S. patent application Ser. 08/565,658, filed Nov. 29, 1995, which are similar to the lift latches described with respect to FIGS. 15–20 hereinafter. Each portion 49, 50 of the coupler 33 is confined to a straight vertical course by related, conventional guide rails 54 and roller guides 57, shown in FIGS. 2 and 3 but not shown in FIGS. 1 and 4. Other than in the transition section 44, the guide rails 54 will be parallel to the rails 40, 41.

The car 31 is coupled to the rails 41 by roller guides 55 mounted near the top of the car 31 (FIG. 4) and the roller guides 56 being mounted near the bottom of the car 31 so as to maintain the car level within the transition section 44, as described hereinafter with respect to FIGS. 12 and 13.

Each car 31 has a pair of LEM secondaries 58 disposed within a U-shaped bracket 59 which surrounds a LEM primary 60 disposed within each hoistway. When cab 31 is traveling on the rails 41, the secondaries 58 and primary 60 comprise the LEM 46. But when, as described hereinafter, the cab 31 travels downwardly on the rails 40, the secondaries 58 will form the LEM 45 with a primary disposed near the rails 40, which is similar to the primary 60.

Referring again to FIG. 1, when the car 30 reaches the top of the rails 41, the car will be above the upper landing 43; it will be taken off the rails 41 for passenger unloading and reloading, turned around, and delivered to the rails 40, in a manner described with respect to FIGS. 14–20 hereinafter. Similarly, when it reaches the bottom of the rails 40, it will be removed for unloading and loading, turned around, and then returned to the rails 41 once again.

Figure 5:
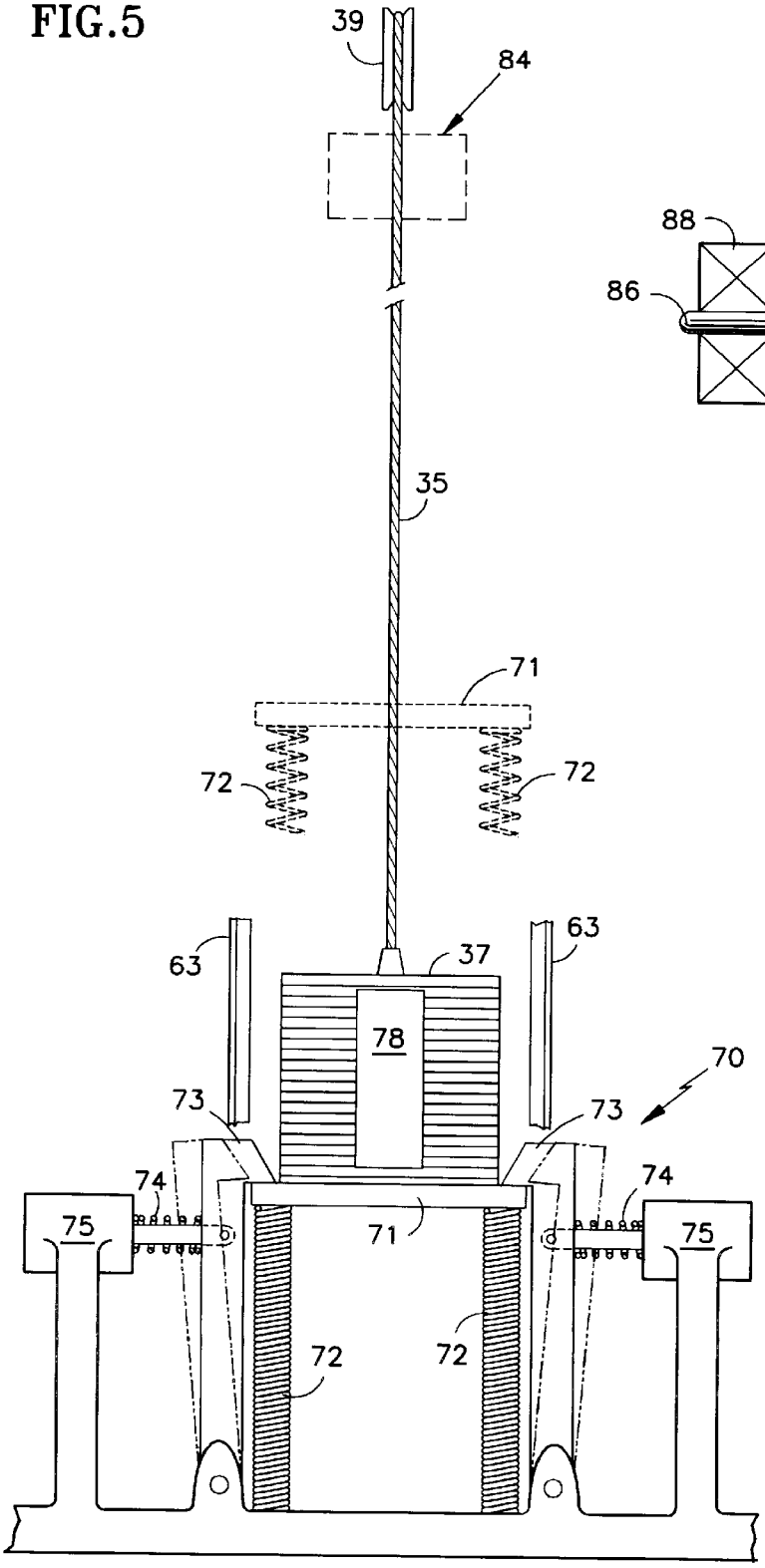
FIG. 5 is a partial, front elevation view of a latched spring buffer for capturing, storing and returning counterweight energy.

Referring now to FIGS. 1 and 5, a latched, spring buffer 70 includes a platform 71 supported by at least two springs 72 disposed at the extreme bottom end of the path of the counterweight 37 as defined by its conventional guide rails 63. The platform can be held in a position with the springs 72 compressed (as shown) by means of two or more latches 73 which are urged into the latched position, shown by means of springs 74, and which can be retracted so as to release the platform 71 against force of the springs 72 by means of solenoids 75, or other suitable actuators. In operation, as the coupler 33 connected to the counterweight 37 is raising an elevator car 30 or 31, eventually that car is engaged by the LEM 46, and the car slides off the coupler 33. At that point in time, there is insufficient downward force on the coupler side of the traction machine 39 so that the traction machine cannot arrest the motion of the counterweight 37. The counterweight 37, will, however, engage the platform 71 in a position shown dotted in FIG. 5 where the springs 72 are fully extended, and compression of the springs will absorb the energy of the decelerating counterweight 37. When the counterweight 37 compresses the springs 72 so that the platform 71 falls below the lips of the latches 73, the latches 73 will engage as shown and prevent the counterweight from oscillating on the springs 72. When it is time to accelerate the related coupler 33 in a downward direction so that it can be engaged with a downwardly traveling car 30 or 31, the solenoids 75 are actuated to release the latches 73 and the springs 72 will launch the counterweight 37 upwardly. Thus, the energy stored during deceleration, in the form of compressed springs, is released during acceleration. In order to control precisely the position and speed of the related coupler, the counterweight 37 may also be guided by a LEM, the secondary 78 of which is disposed on the counterweight 37. The primary winding 79 of the LEM, shown in FIG. 1 but is not shown in FIG. 5, would extend essentially from the platform 71 several stories upwardly along the path of the counterweight. The approximate positioning of the latched buffer 70 and a LEM primary winding 79 are shown in FIG. 1. The counterweight 36 will also have some means for decelerating and accelerating it, such as a LEM 80 similar to that described with respect to FIG. 5, but gravity will decelerate the counterweight 36, so the latched spring buffer 70 is not needed therewith. In some embodiments, it is possible to use just a LEM for decelerating and re accelerating the counterweights, provided the LEM has a sufficient force producing capacity.

Figure 6:
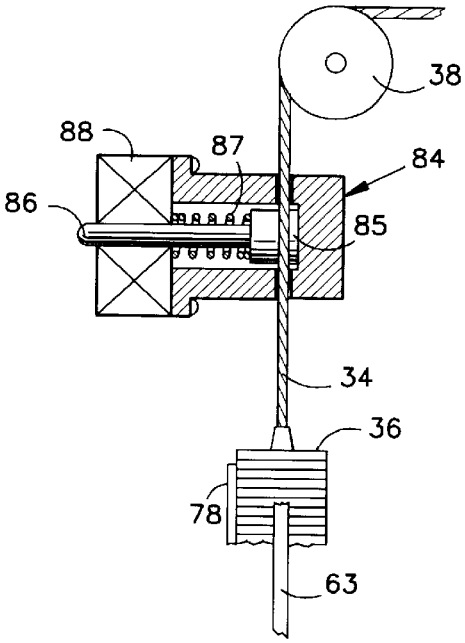
FIG. 6 is a partial, partially sectioned, side elevation view of a rope brake.

Referring to FIG. 6, the counterweight 36 is shown in the extreme uppermost limit of its travel path. In the case of an upwardly traveling counterweight, once the car 30 or 31 has been disengaged from the corresponding coupler 32, the counterweight 36 will tend to decelerate from gravity, making it unnecessary to utilize a buffer of the type shown in FIG. 5. However, the counterweight 36 may be decelerated in a stabilized manner, and accelerated properly to have the correct position and speed, by means of a LEM, including a LEM secondary winding 78 on the counterweight 36, and the LEM primary winding 80 illustrated in FIG. 1. To hold the counterweight 36 in its uppermost position, a brake 84 may grip the rope 34 between an anvil 85 and an armature 86. In a fashion similar to a regular elevator sheave brake, the armature 86 may be urged toward the anvil 85 by a strong spring 87 and the brake released by energizing a solenoid 88 which attracts the armature 86, thereby releasing the grip on the rope 34. Other forms of brakes may be used if desired. In some cases, the invention may be practiced utilizing only the LEM to retain a counterweight in its upward position between deceleration and acceleration. The position of brakes 84 is shown in FIG. 1.

Figure 7:
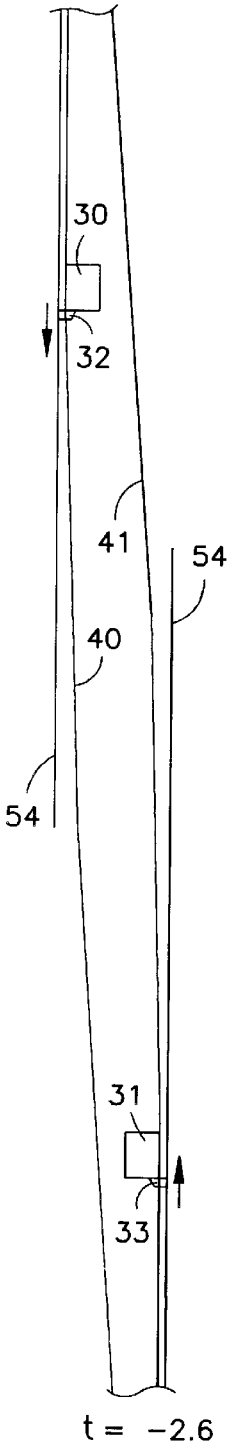
FIGS. 7–11 are simplified, stylized, fractional side elevation views of the elevator system of FIGS. 1–6, illustrating progression of elevator cars in the upward and downward directions.
Figure 8:
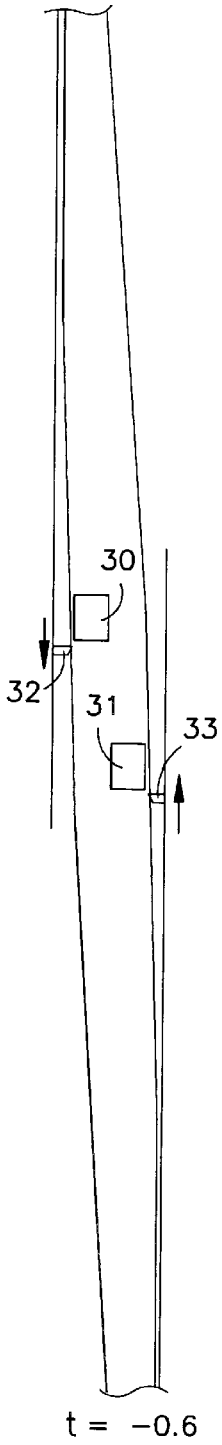
Figure 9:
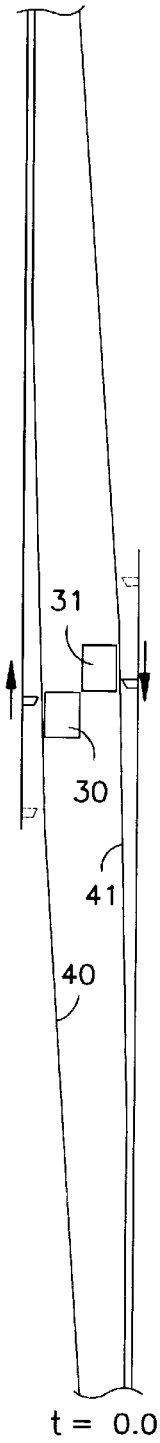
Figure 10:
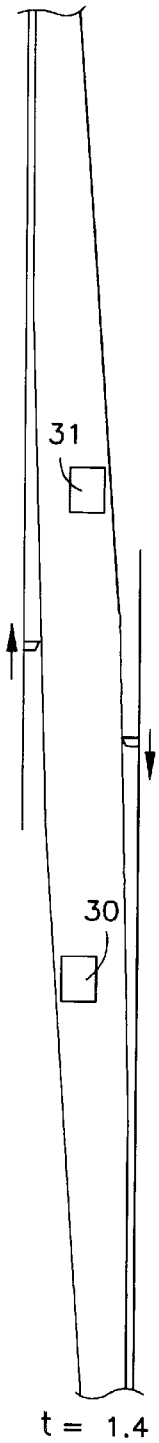
Figure 11:
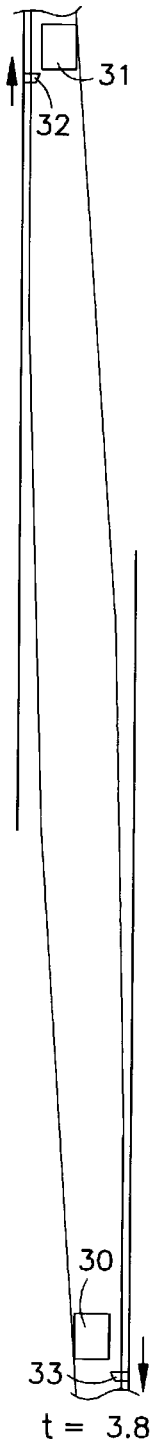

In FIG. 1, the couplers 32, 33 are shown at a position where the LEM secondaries on the cars 30, 31 have begun to engage the LEM primary 60 within the transition section 44. In FIGS. 7–11, it is assumed that the couplers 32, 33 will move at a speed of about ten meters per second, and that the couplers can be accelerated and decelerated at about ten meters per second per second (gravity). In FIG. 7, the couplers 32, 33 have reached the point where the LEM secondaries on the cars 30, 31 have engaged the LEM primaries 60, in a corresponding transition section, and begin to be moved off the couplers 32, 33 toward the other hoistways. This is approximately 26 meters and 2.6 seconds before reaching the mid point where the cars pass, illustrated in FIG. 9. In FIG. 8, the cars 30, 31 have each cleared the corresponding coupler 32, 33 and the coupler begins to decelerate to a stop so that it can travel in the opposite direction to pick up the other car. This occurs about six meters and 0.6 of a second before the mid point of FIG. 9. Somewhere between the time depicted in FIG. 8 and the time depicted in FIG. 9, the couplers become stopped and begin acceleration in the opposite direction. In FIG. 9, the cars have reached and passed a mid point so that the upper part of car 30 is level with the lower part of car 31. Once the cars pass each other, the inclination of the tracks 40, 41 toward the opposite hoistway can be greater than it is prior to the cars passing, limited by passenger comfort during the lateral movement. In FIG. 10, the cars are midway between the left hoistway and the right hoistway, which occurs 14 meters and 1.4 seconds beyond the mid point. In FIG. 11, the cars 30, 31 and the couplers 32, 33 have reached points where the couplers are traveling at 10 meters per second per second and are about to engage the respective cars; this occurs about 38 meters and 3.8 seconds from the mid point. Each car will travel approximately 18 more meters before it is disposed completely on the corresponding coupler, at the end of the transition section 44 (FIG. 1). Notice that the left and right rails 40, 41 are not vertically symmetrical about the mid point because of the need to first clear the couplers 32, 33 before the cars pass, or, alternatively, have a transition section which is significantly longer than that provided in this embodiment.

In FIG. 12, the manner in which the rails 41*a*, 41*b* keep the car level is illustrated. When the car is traveling perfectly vertically, the rails 41*a* and 41*b* are totally parallel in the same planes. However, once the car enters the transition section, the rails become tilted in a manner that for any position of the car, the rail 41*a* is farther away from the car than the rail 41*b*, thus keeping the car 31 level. FIG. 13 illustrates the similar circumstance when the car 30 is traveling downward on the rails 40. FIGS. 12 and 13 illustrate an angle with respect to vertical of about 3.80° which is the maximum angle in the embodiment of FIGS. 1–11, being the angle that the rails take beyond the point where the cars pass. Obviously, the rails 40*a*, 40*b*, 41*a*, 41*b* are tilted with respect to the mounting (on the car) of roller guides 55, 56 with which the rails are engaged. This is accommodated by means of self-tilting roller guides 55, 56, as is described with respect to FIGS. 24–26, hereinafter.

Figure 14:
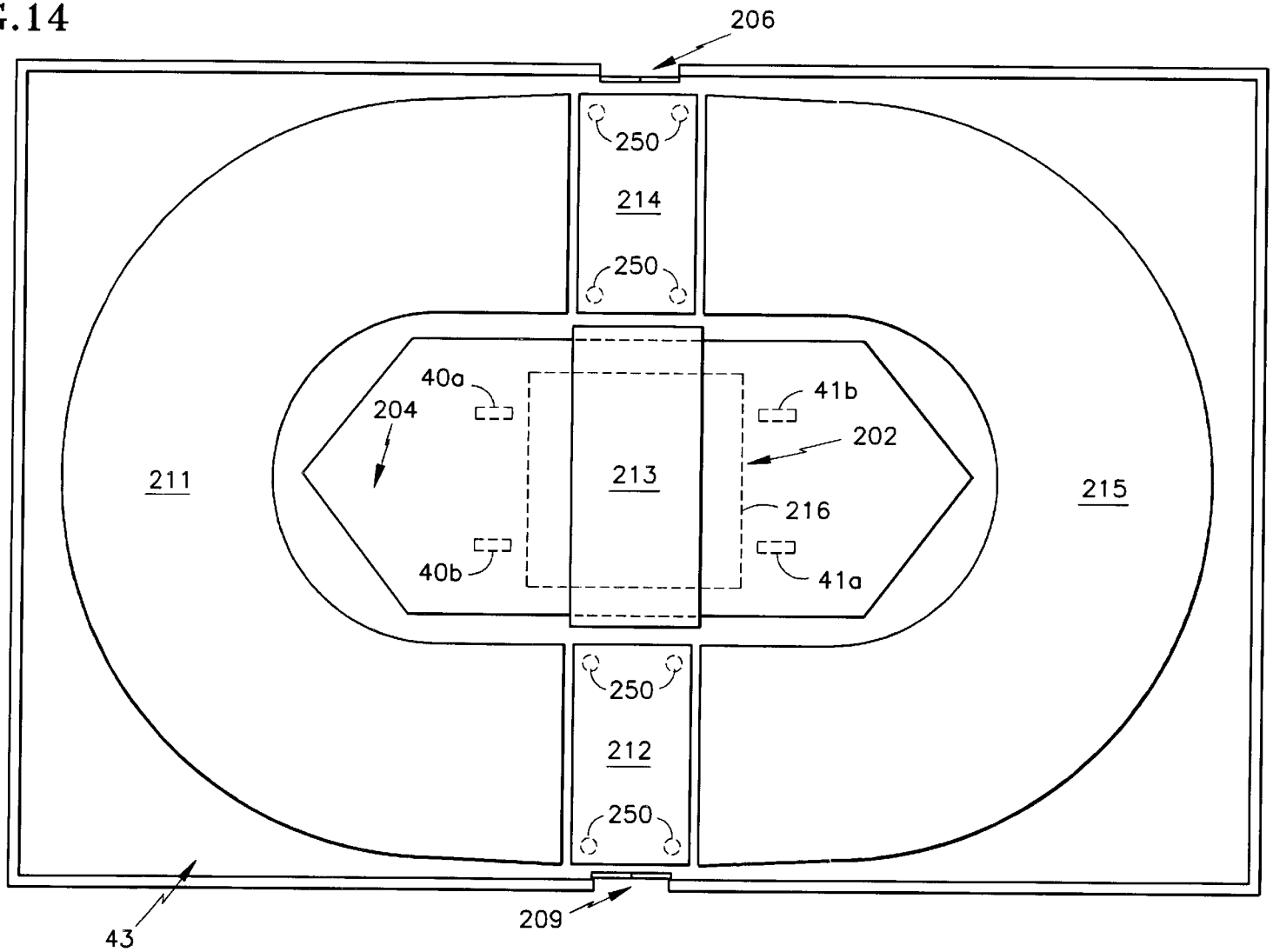
FIG. 14 is a simplified plan view of an upper passenger landing.

Referring now to FIG. 14, the upper passenger landing 43 surrounds a hoistway 202 and an area 204 around the elevator hoisting mechanisms. It also includes an unloading lobby 206 and a loading lobby 209. Alternatively, the lobby 206 may be used to unload one car and then load a car that was previously unloaded at the lobby 209, and vice versa, if desired. The elevator cars are moved above the passenger landing 43 on guideways or tracks 211–215 by means of trolleys, such as a trolley 223 shown straddling the tracks in FIGS. 15 and 17, as described hereinafter. The dotted lines 216 depict the outline of an elevator car when at the top of the hoistway. Each elevator car traveling up will be removed from the hoistway and be moved to an unloading lobby, where its doors will open and passengers may exit the car. Then the car will be moved to a loading lobby where the doors are again opened so that passengers may enter. After the car is loaded and the doors closed, the car is moved to the hoistway so as to be lowered therein by the hoisting mechanism. Any car can use either the lobby 206 or the lobby 209 for unloading (and the other lobby for loading) because the cars have two sets of doors. Whenever a car is at a lobby for unloading or loading, it is raised slightly and stabilized by four jacks 250, which are disposed as shown beneath the cars. This allows the trolley to be released and move on. The circular paths 211, 215 cause the cars to turn around so that the roller guides 55 will face the correct tracks 40 or 41. Multiple circular tracks permit having extra cars in the process at the landing. But, only one circular track is needed.

In this embodiment, there may be as few as three trolleys: two hoistway trolleys operate between the hoistway and the lobbies, and one trolley (or more, if extra cars are used) operate between unloading lobbies and loading lobbies. It should be borne in mind that when a trolley releases a car and the car is being held by the jacks, a trolley can pass over it without any interference whatsoever, and the trolley can remain above the car until another trolley with a car approaches.

Figure 15:
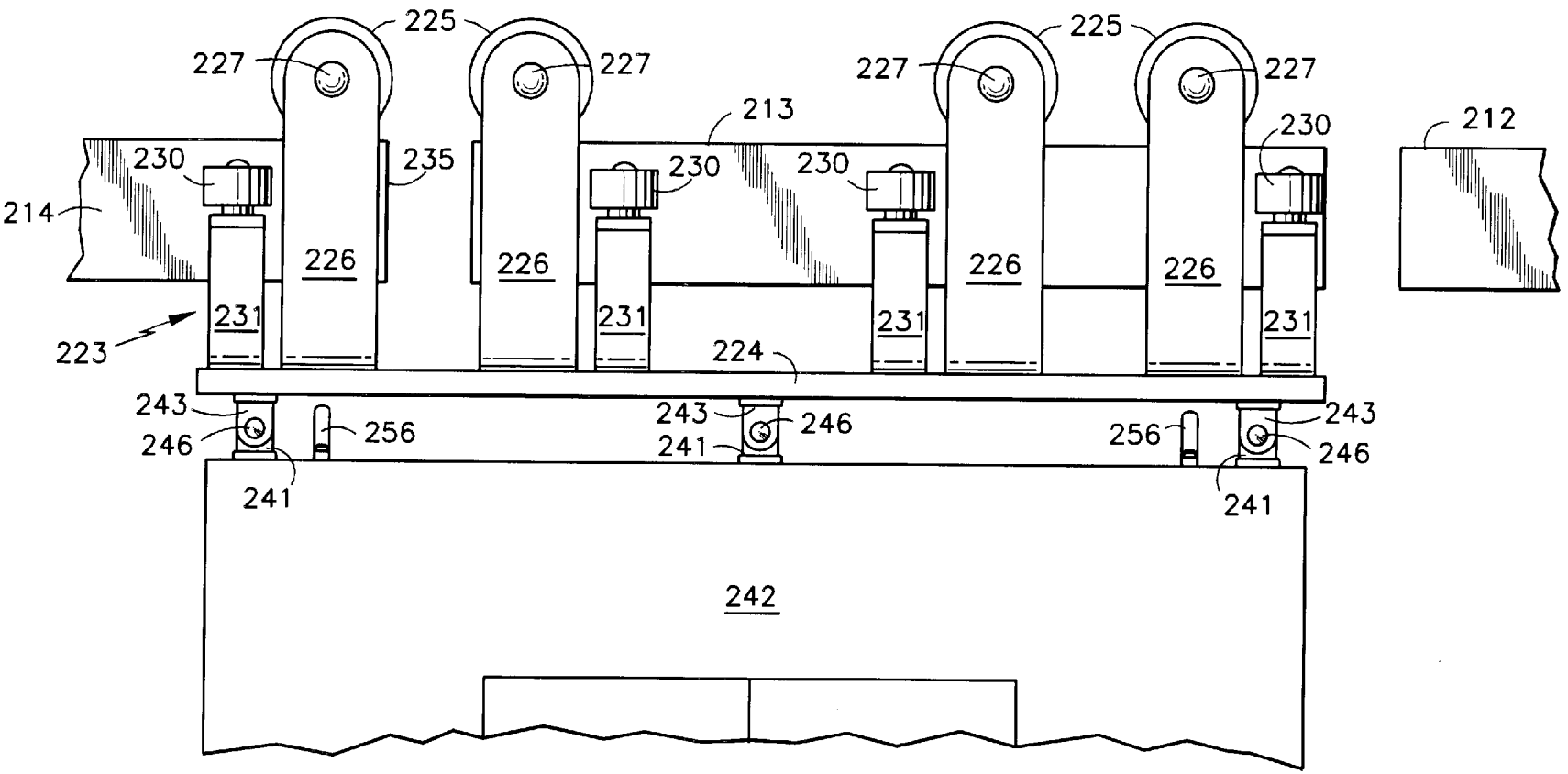
FIG. 15 is a partial, side elevation view of a trolley supporting an elevator car on the tracks of FIG. 14.
Figure 17:
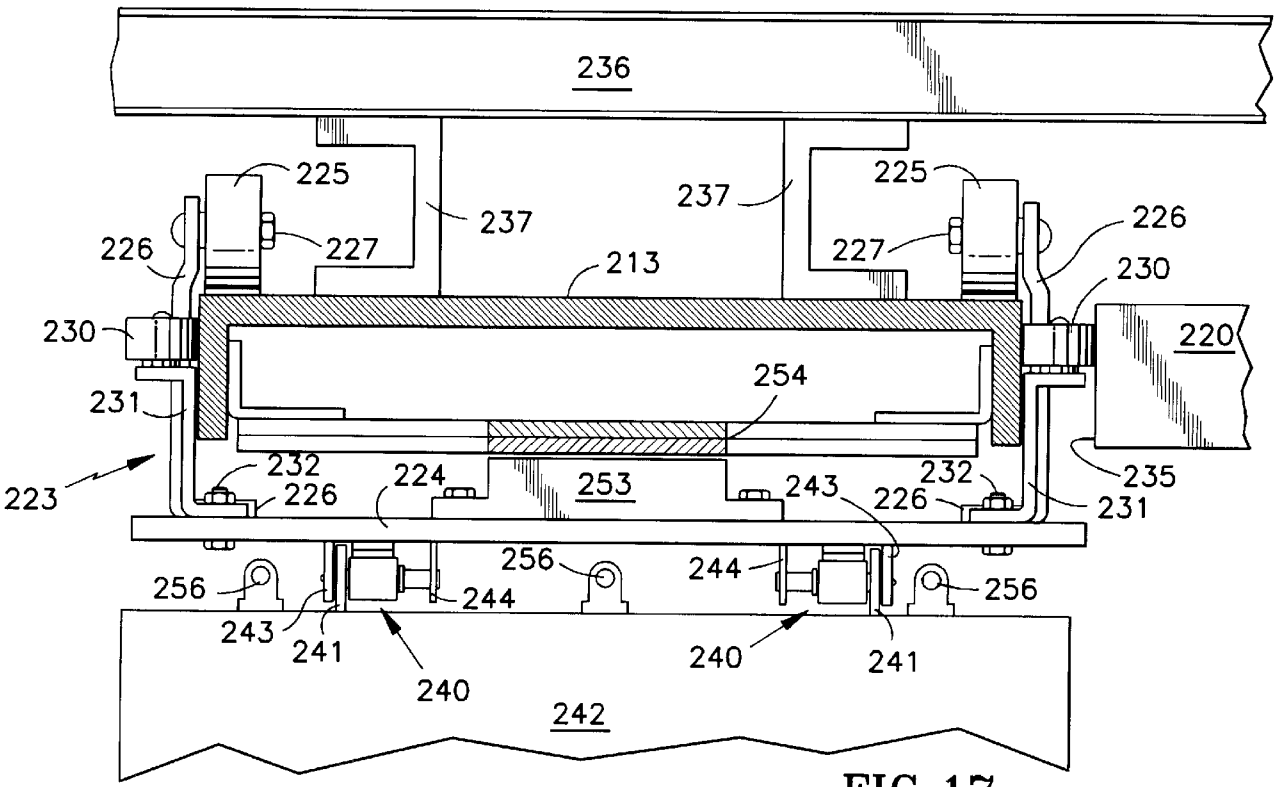
FIG. 17 is a partial, partially sectioned end elevation view of the trolley of FIG. 15 illustrating support of the tracks of FIGS. 14 and 15.
Figure 16:
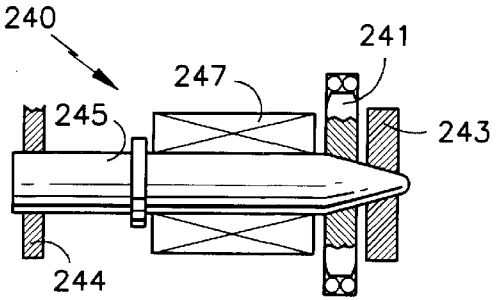
FIG. 16 is a sectional view of a lifting latch.

Referring to FIGS. 15–17, each trolley 223 comprises a main plate 224 which is suspended from eight wheels 225 by means of brackets 226 secured to the plate 224 by welding or bolts (not shown) or in any other suitable way. The wheels 225 are journaled to the brackets 226 in any suitable fashion, such as by means of threaded axles 227. The wheels 225 roll on top of opposite sides of the tracks 213, 214 (as well as track 212 when at the lobby 209). The trolley 223 is centered on the tracks 212–214 by means of eight guide rollers 230, four on each side, which are journaled to brackets 231 that are fastened to the plate 224 in any suitable fashion, such as by welding or by bolts 232. Each of the tracks 212–214 (FIG. 14) is separated from the adjacent tracks. The separations 235 allow passage of the brackets 226, 231 and the guide rollers 230 as a trolley passes onto one of the lobby segments 212, 214, in either of the two orthogonal directions of track shown in FIG. 14. The wheels 225 and rollers 230 are separated in pairs so as to span the separations 235 smoothly. The track 212 may correspond to the lobby 209; the track 214, the unloading lobby 206. Because each of the tracks 212,214 must be isolated to permit passage of the brackets and guide rollers, each of the tracks must be suspended from above (FIG. 17), such as by one or more I beams 236 or other suitable structure, by means of brackets 237 which may be fastened between the tracks 211–215 and the support structure 236 in any suitable way, such as by welding or bolts (not shown).

In FIG. 17, the trolleys have, attached to the underside of their plates 224, six lifting latches 240 which cooperate with six corresponding lifting eyes 241 disposed on each of the elevator cars 242.

Figure 18:
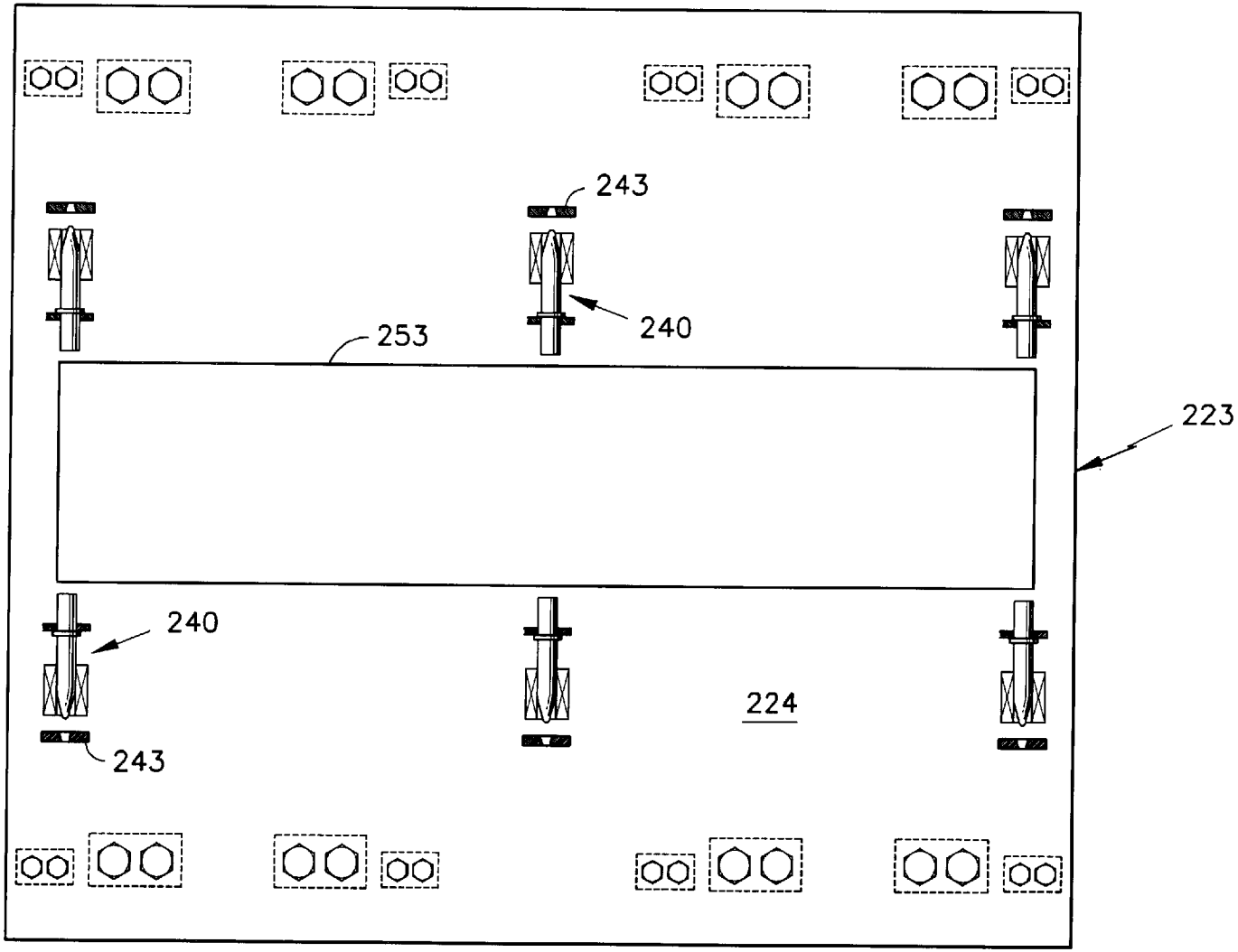
FIG. 18 is a bottom plan view of the trolley of FIGS. 15 and 17.
Figure 19:
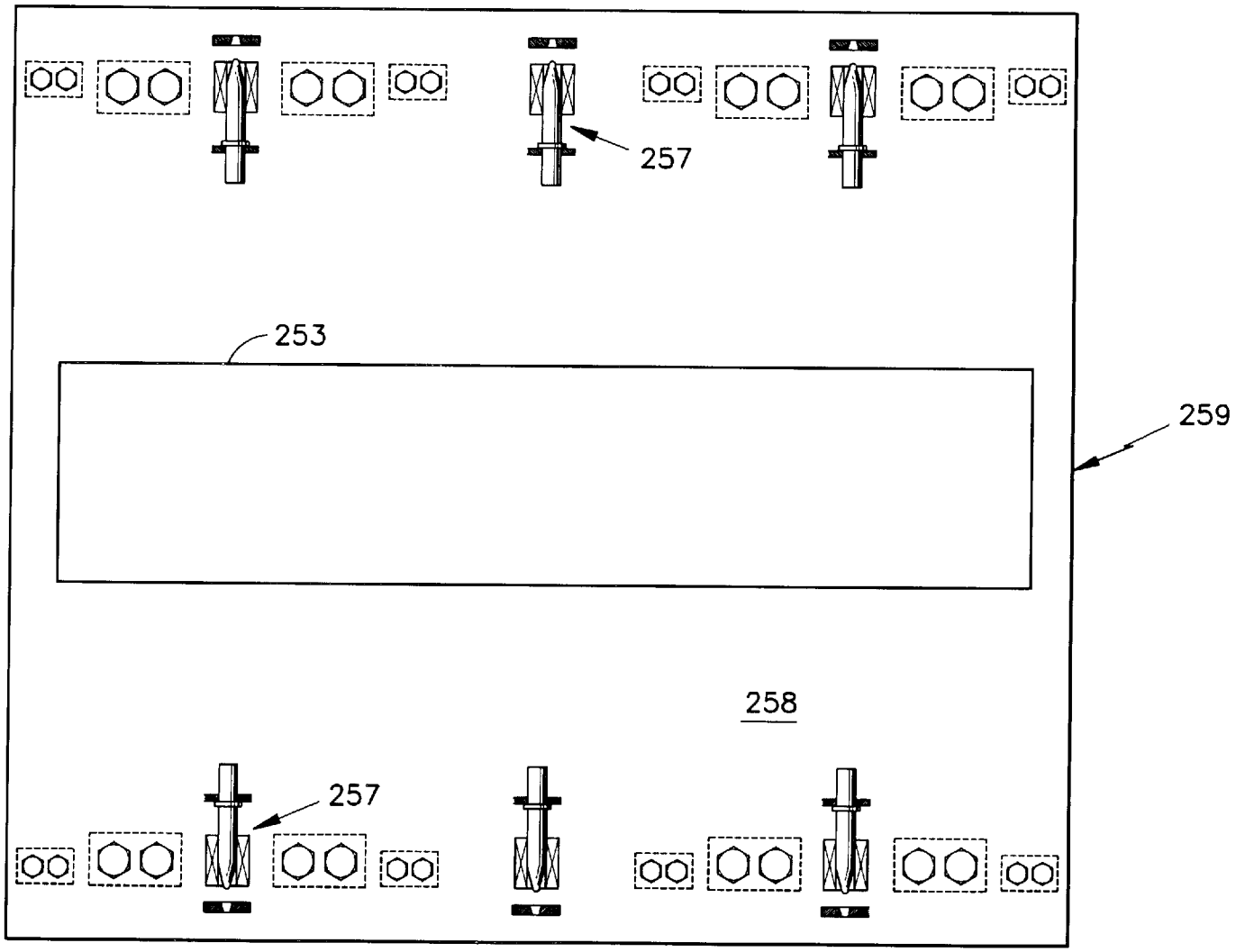
FIG. 19 is a bottom plan view of another trolley which supports elevator cars on the tracks of FIG. 14.
Figure 20:
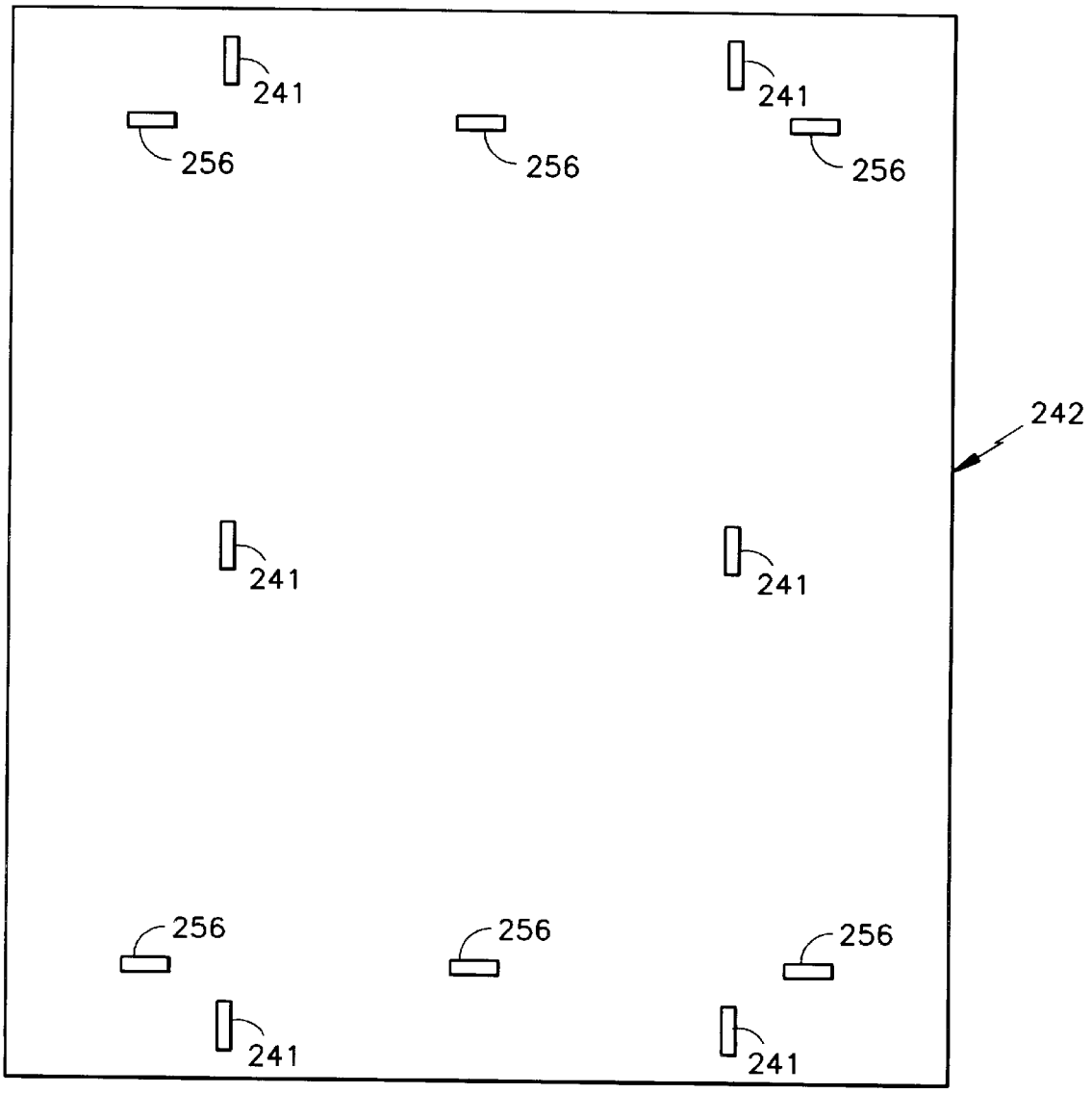
FIG. 20 is a simplified top plan view of an elevator car to be supported by the trolleys of FIGS. 18 and 19.

In FIG. 16, each lifting latch 240 comprises a pair of lifting eyes 243, 244 and a bolt 245 which passes through holes 246 (FIG. 15) in each lifting ring. The lifting eye 244 acts as a guide as the bolt 245 transfers from the operative position shown in FIGS. 15–17 and an inoperative position shown in FIGS. 18 and 19. The lifting eyes 241, 243 are tapered so as to assure the capability for the bolt to strike them properly while at the same time causing the lifting of the elevator car 242 to be quite stable so as not to jostle the passengers in the car. The bolt 245 is moved between the operative and inoperative positions by DC current of a corresponding polarity in a solenoid 247, which acts against the north and south poles of the bolt 245, which is permanently magnetized with opposite poles at either end. Current of one polarity will cause the bolt 245 to advance to the operative position shown in FIG. 16, and removal of the current will cause the bolt to simply remain in that position. Current of the opposite polarity will cause the bolt to move to the left in FIG. 16, into the inoperative position as shown in FIGS. 18 and 19. With no current, the bolt simply remains where it has been placed last.

When a car has been moved to either an unloading lobby or a loading lobby by one of the trolleys 223 (or by a hoistway trolley 259, FIG. 19), a corresponding set of four jacks 250, which may be hydraulic, pneumatic, screw or any other form of jacks, will raise up slightly thereby stabilizing the elevator car so that passengers may exit or enter without the car shaking, and reducing somewhat the load on the lifting latches 240, thereby rendering it easier to retract the bolts 245 from the lifting eyes 241, 243 (FIG. 16). Once the jacks 250 have been raised, then a trolley which brought the car from the hoistway to a lobby can be moved out of the way so another trolley can move the car from that lobby to the other lobby.

As shown in FIG. 17, the trolley 223 is moved around the tracks 211–215 by means of a linear electric motor (LEM), including LEM primary windings 253 disposed on the upper side of the plate 224 and a LEM secondary 254 which is disposed under and within the tracks 211–215. The LEM is not illustrated in FIG. 15 for clarity. The general position of the LEM primary 253 is illustrated in FIGS. 18 and 19.

In order for the trolleys, such as trolley 223, to be able to travel around the oval path and for the hoistway trolleys to reach the lobbies without interference, it is necessary that the lifting eyes 241, and similar lifting rings 256 (FIG. 20) used in conjunction with the hoistway trolleys, not interfere with the passage of the lifting latches 240, or of similar lifting latches 257 (FIG. 19) disposed on the bottom of the plate 258 of either of the hoistway trolleys 259. The two patterns illustrated in the bottom views of the oval trolleys 223 (FIG. 18) and hoistway trolleys 259 (FIG. 19) result in a pattern on each car (FIG. 20) of lifting eyes 241 for use in conjunction with the trolleys and lifting eyes 256 for use in conjunction with the hoistway trolleys 259. Of course, other arrangements may be utilized if desired. Since the hoistway trolleys travel only short reciprocal distances, they may be powered by cables reaching from the overhead support structure. The oval trolleys may be powered by conventional power rails or, the trolleys must have passive secondaries and the tracks may have active primaries.

Figure 21:
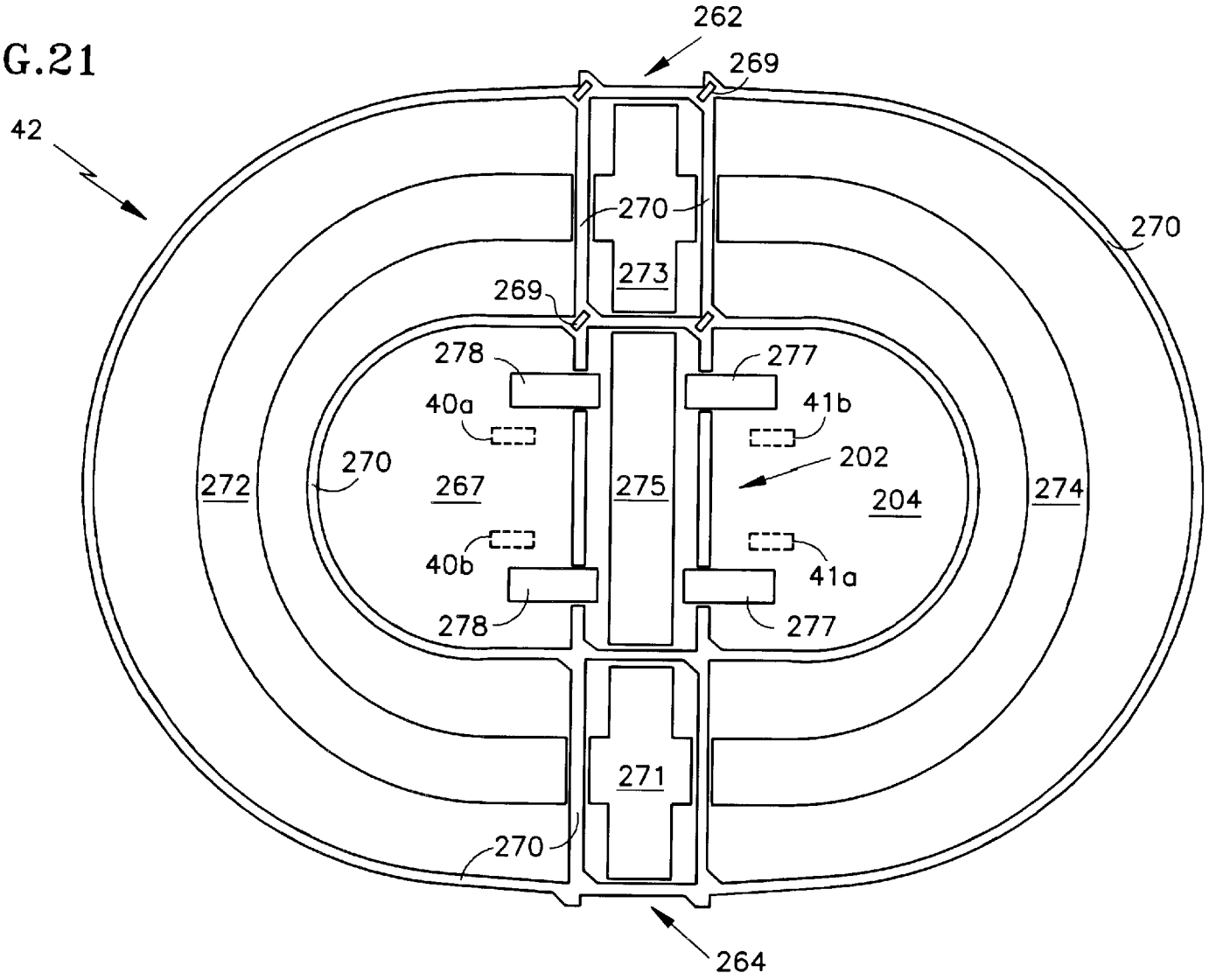
FIG. 21 is a partially sectioned top plan view of a lower passenger landing.
Figure 22:
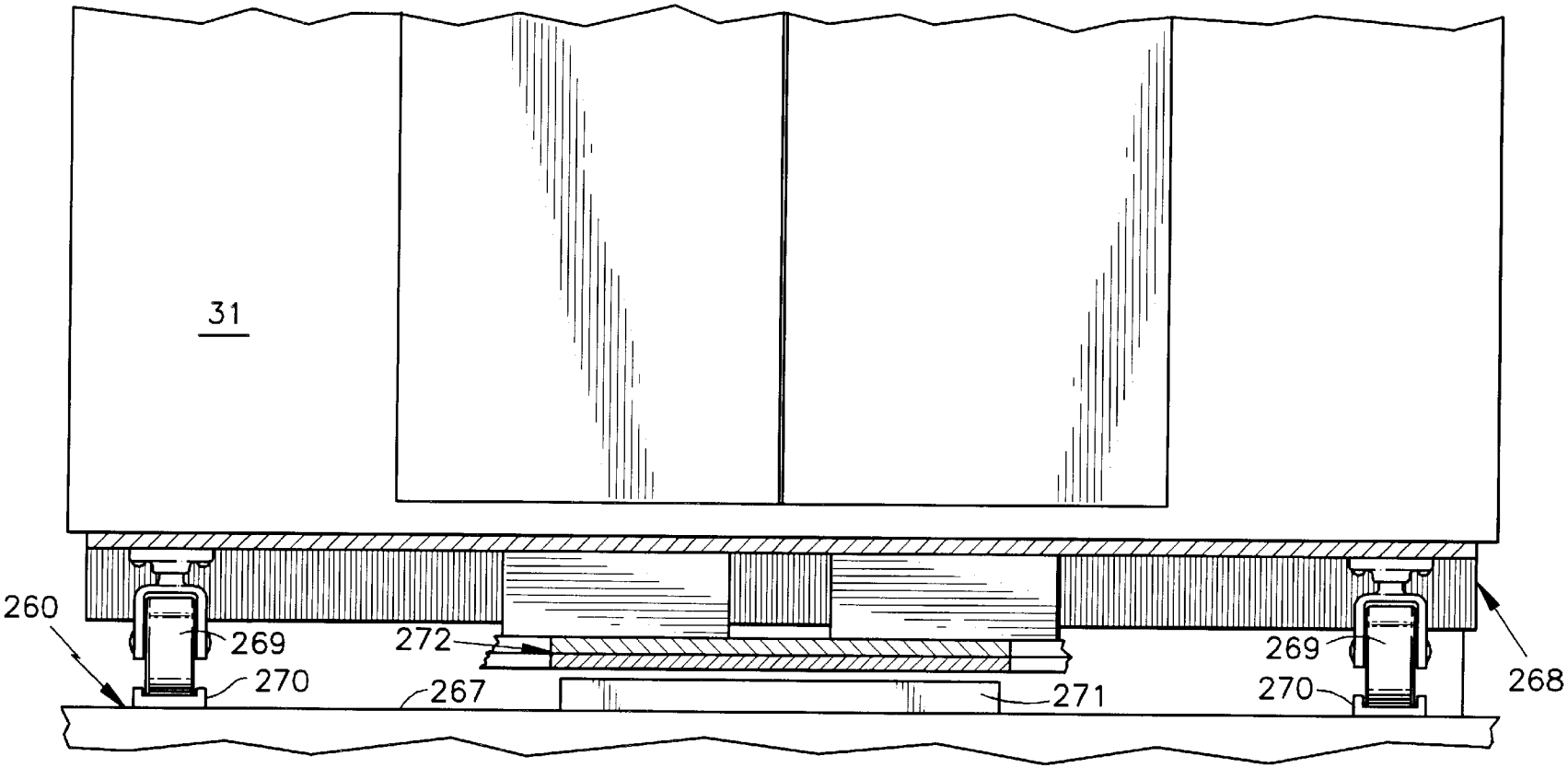
FIG. 22 is a partial front elevation view of an elevator car being supported by an attached dolly on the passenger landing of FIG. 21.

At the bottom of the hoistways, the situation is in a sense opposite from that at the top. It is possible to support things from underneath, but there can be no interference from above. In FIG. 21, elevator cars are received at a lower passenger landing 42 at the bottom end of the hoistway 202, and they are moved to either an unloading lobby 262 (or 264) where the car doors are opened so that passengers may exit the car. Then each car is moved from the unloading lobby 262 (or 264) to a loading lobby 264 (or 262) where the doors are again opened so the passengers may enter the car. Thereafter, cars are moved to the hoistway 202 for travel to the upper passenger landing of FIG. 14. In this embodiment, each elevator car has a dolly 268 (FIG. 22) attached to its underside, which has casters 269 that roll in tracks 270 that define the path of movement of the dolly 268. The casters 269 are free to turn in any direction when urged to do so, in the known fashion. The dolly 268 is drawn along the tracks in a desired fashion by means of a LEM which includes the LEM primary 271 disposed on the floor 269 of the lower passenger landing, and T-shaped LEM secondaries 272 disposed beneath the dolly 268 in proximity with the primary 271. The LEM primary 271 is illustrated in FIG. 21 as being between the hoistway 202 and the lobby 264. Other LEM primaries 272 and 274 provide a pair of paths between the lobby 262 and the lobby 264. Primaries 273, 275 provide a path between the hoistway 202 and the lobby 262, and primaries 271, 275 provide a path between the lobby 264 and the hoistway 202. Note that at the upper passenger landing, the jacks 250 relieved the lift latches on the trolleys so that the trolleys could be moved. In the embodiment illustrated in FIG. 21, the dollies on each car stay with that car at all times.

In FIG. 21, the tracks 270 at the unloading lobby 262 are shown with four casters 269 of a car therein. In each case, the casters will become aligned with the track in the direction of travel of the car and will remain so aligned when stopped. For instance, a car that moves from the down hoistway to the unloading lobby has its casters initially aligned in parallel with the LEM primary 275. As that dolly is forced to move to the left, its motion will be lateral to the alignment of the casters, but the shape of the intersection will cause the casters to readily realign with the tracks, as is illustrated in process for a car at the lobby 262. Use of LEM secondaries and simple casters provide a passive dolly that needs no power. Of course, other arrangements may be utilized to move elevator cars around in the lower passenger landing.

Referring again to FIG. 2, the dolly 268 disposed on the bottom of the car 31 is not shown. However, depending on the structure of the couplers 33, the portion thereof beneath the cab may interfere with the car reaching the lower landing. For that reason, a pair of recesses 277 (FIG. 21) are provided in the floor 267 of the lower landing to accommodate the structures of the coupling portions 49 and 50. Similar recesses 278 are provided for the structures of the coupler 32. In order to allow passage of casters over the recesses, the recesses such as 278 which are not used when the opposite coupler (such as coupler 33) is at the lower landing, may be covered with plates which are raised and lowered by suitable actuators. Or, other arrangements may be made to suit this embodiment.

In order for the cars to be removed from the hoistways, either by the trolleys at the upper passenger landing or by the dollies at the lower passenger landing, the guides, such as roller guides 55, 56 that guide each car along the guide rails must be released from the guide rails in a manner to allow the car to slide sideways without interference between the guide rails and the roller guides. In this embodiment, it is assumed that the guide rails 40, 41 extend upwardly and downwardly just as far as is necessary to guide the car until it comes to a stop at the point where it will either be picked up by a trolley or is resting on its dolly. In order to clear the rails, the roller guides are raised above the end of the rails when at the upper passenger landing and are lowered beyond the bottom of the rails when at the lower passenger landing.

Figure 23:
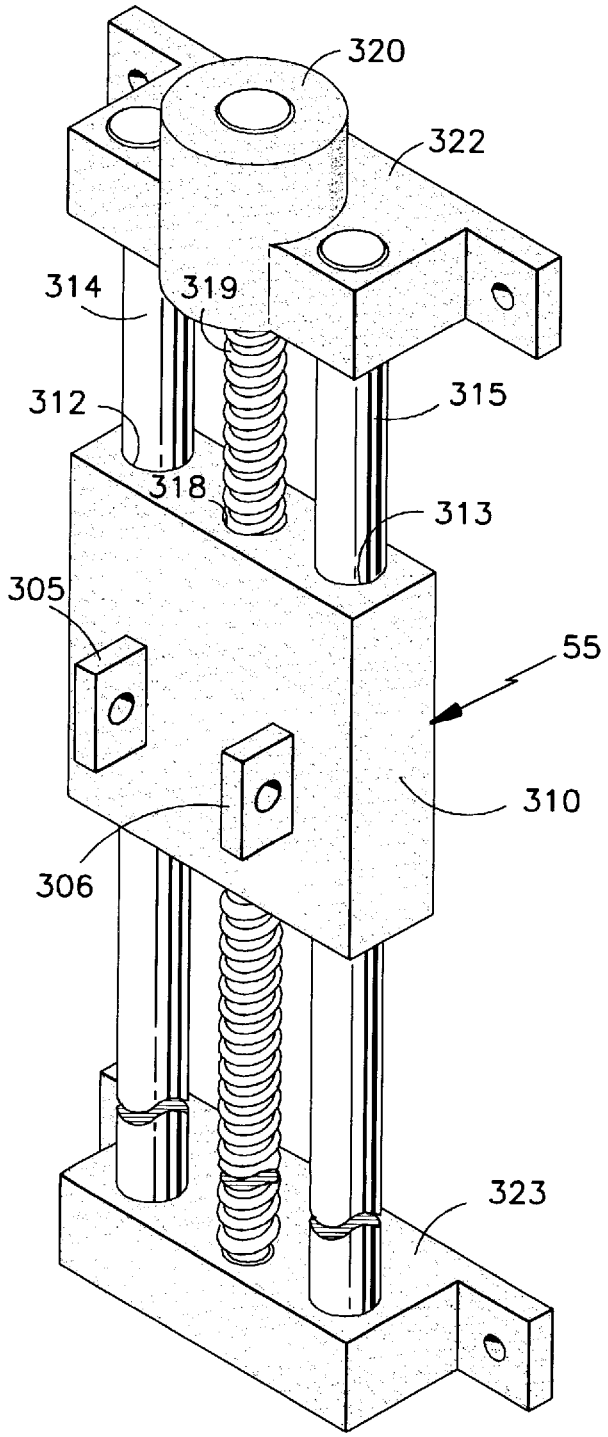
FIG. 23 is a simplified, partially sectioned and broken away perspective view of a portion of a releasable, self-tilting roller guide assembly.

In FIG. 23, a releasable roller guide 55 includes a pair of hinge mounts 305, 306 to which a self-tilting guide roller assembly (FIGS. 24–26) is disposed on a vertically moveable block 310. The block has two clearance holes 312, 313 for corresponding rods 314, 315 that guide the moveable block 310. The block has a threaded hole 318 that receives a screw or worm gear 319 which can be turned by a motor 320 whenever the guides (fastened to hinge mounts 305, 306) are to be adjusted upwardly or downwardly. The motor 320 is formed within an upper support 322, and the lower end of the screw 319 is journaled in a lower support block 323. The guide rods 314, 315 are positioned by the upper and lower support blocks 322, 323. The blocks 322 and 323 may be disposed on the side of the elevator, on either side of the LEM secondary bracket 59. When the elevator is to be run in the hoistway, the block 310 is centered vertically between the supports 322 and 323. At the upper passenger landing, once the car has been engaged by a trolley, the block 310 is moved to its extreme upward position, by operation of the motor 320 which turns the screw 319 thereby moving the block 310, where the guide rollers clear the top of the guide rails 40, 41 so that the car may be translated in a direction parallel with the two guide rails. Of course, other arrangements may be made. Whenever the car has been lowered to the point where it is being supported by a dolly at the lower passenger landing, the motor 320 can turn the screw 319 in a direction so as to drive the block 310 downwardly so that the guide rollers will clear the bottom of the guide rails as the car is moved laterally into the landing.

In FIG. 24, the vertically moveable block 310 has a self-tilting guide roller assembly 328 disposed to the hinge mounts 305, 306 by means of a bolt 329 having nuts 330. The assembly 328 has three pairs of guide rollers 331–333 journaled to it in any suitable way. The rollers of each pair 331–333 make contact with opposing faces on the guide rail 40*b*. As is illustrated in FIGS. 25 and 26, the pair of rollers 331 are disposed above the center of the rollers 333, and the pairs of rollers 332 are disposed below the center of the rollers 333. When the guide rail 40*b* is at an angle with respect to the vertical, within the transition section 44 (FIGS. 1 and 13), the vertical displacement of the roller pair 331 from the roller pair 332 will cause a corresponding horizontal displacement which in turn causes the assembly 328 to tilt accordingly so that the axis of rotation of the rollers 333 will remain normal to the surface, and the rollers 333 will not be scuffed.

Figure 28:
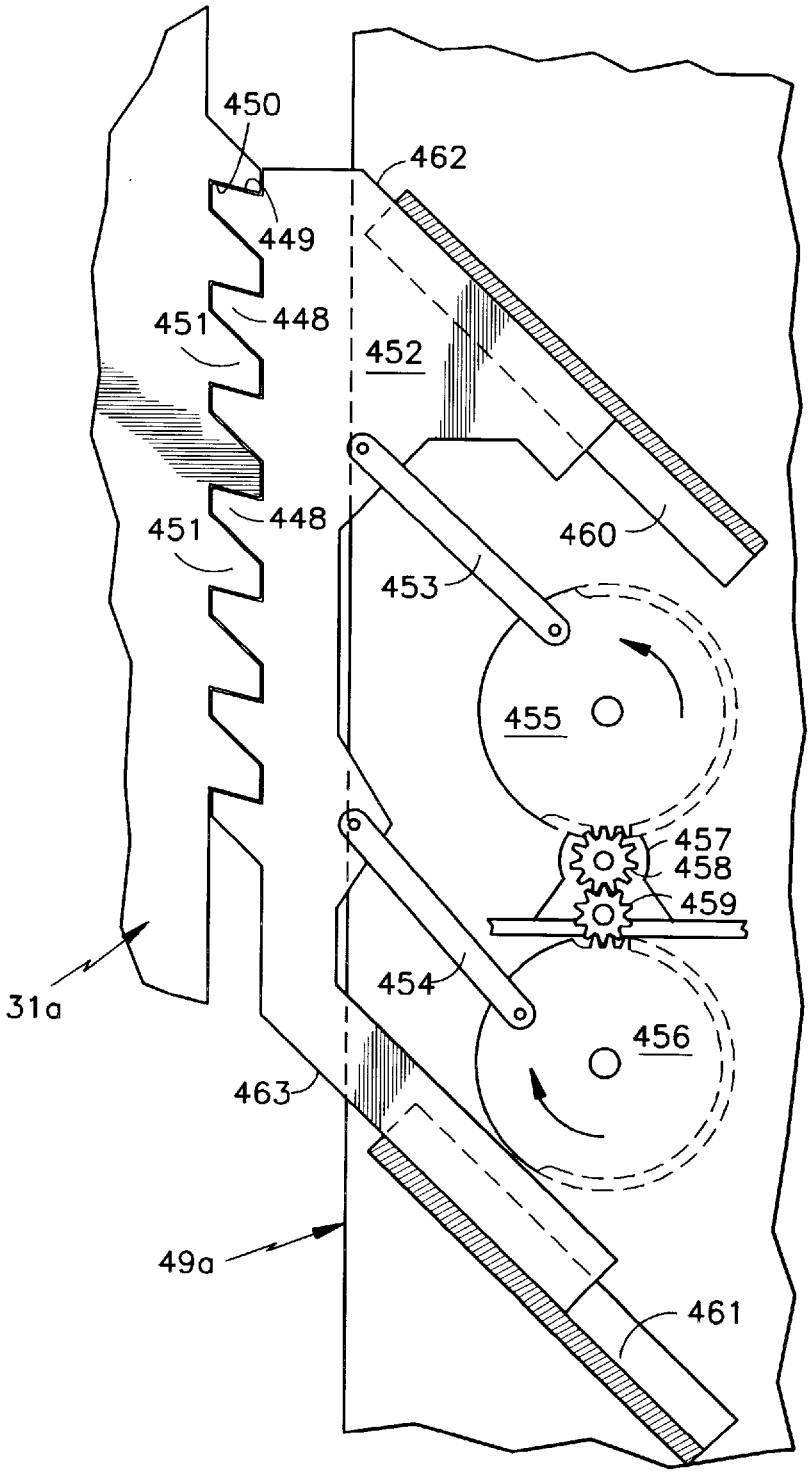
FIGS. 28 and 29 are partial, partially sectioned, side elevation views of the coupler of FIG. 27, in the engaged and disengaged positions, respectively.
Figure 29:
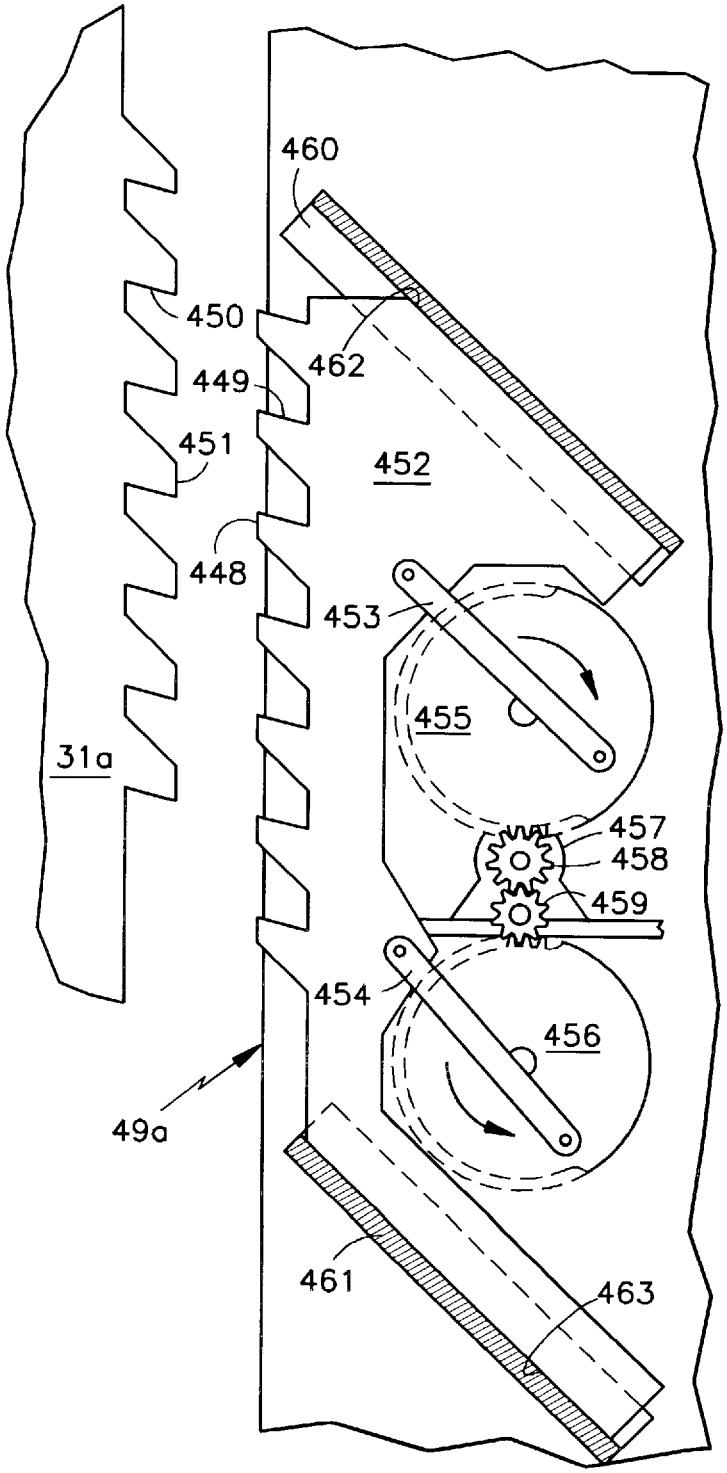

In another embodiment of the invention, a different form of coupler is used. In FIGS. 27 and 28, coupler 49*a* is illustrated as having a plurality of teeth 448 with engagement surfaces 449 at a moderate inclined angle which engage corresponding surfaces 450 of teeth 451 on the elevator car, such as car 31*a*. The angle of the inclination of the surfaces 449, 450 is sufficient so that with the weight of the car 31*a* imposed on the teeth 448, the coupler will remain with the surfaces 449, 450 adjacent to each other when in the engaged position shown in FIGS. 27 and 28. The angle depicted in FIGS. 27 and 28 is 15°, but it could be some other angle. The teeth 448 are disposed on at least one plate 452 connected by arms 453, 454 to sector gears 455, 456. The gears 455, 456 are driven in opposite directions by a motor 457 having a gear 458 that drives the sector gear 455 and that also drives a pinion gear 459 that drives the sector gear 456. As seen in FIG. 28, rotating the sector gear 455 anti-clockwise while rotating the sector gear 456 clockwise will cause upward and outward motion of the plate 452 as confined by a pair of guide rails 460, 461, into the engaged position as shown. Instead of rotating sector gears, linear actuators, such as hydraulic piston actuators or jack screws could be utilized to advance the plate 452 into the engaged position or alternatively retract it into the disengaged position, shown in FIG. 29. In the disengaged position, the teeth on the couplers will not interfere with the teeth on the cars, so that cars and couplers may move freely when adjacent to each other. In FIGS. 27–29 the guides 460, 461 and the corresponding edges 462, 463 of the plate 452 are at an angle (such as about 45°) which is sufficiently greater than the angle of inclination of the tooth surfaces 449, 450 (such as about 15°) so that retraction of the plate 452 (by moving down and to the right in FIG. 28) will allow disengaging the surfaces 449, 450 while the car (such as car 31*a*) continues to be moved in the upward or downward direction by the LEM of the transition section which has recently been engaged therewith. The bottoms of the teeth 448 will slide along the tops of the teeth 451, since the car weight is handled by the LEM, but the disengaging coupler continues at the same speed until fully decoupled. Similarly, the surfaces 449 can be brought into engagement with the surfaces 450 by leftward, upward motion along the guides and surfaces 460–463, which is at a greater angle than the angle of the surfaces 449, 450, as the car (such as car 31*a*) is being moved in either the upward or downward direction by a LEM. Of course, the broadest aspects of the present invention may be practiced utilizing a coupler different from that described with respect to FIGS. 27–29. Except for the coupling mechanism of FIGS. 28 and 29, the apparatus of FIG. 27 is the same as that illustrated in FIG. 2.

FIG. 30 is a view of a hoistway utilizing the apparatus of FIGS. 27–29 which is otherwise similar to FIG. 9. Because the cars 30*a*, 31*a* do not have to laterally clear the coupler, they may pass at any appropriate point, and then begin the lateral traverse to reach the other hoistway. Because of this, the rails 40, 41 will allow the cars 30*a*, 31*a* to travel upwardly and downwardly on the same rail, if desired, and the car could be left in the hoistway for loading and unloading. However, off-shaft loading and unloading saves time and therefore increases passenger handling capacity.

They will traverse to the other hoistway and then pass when the cars travel up and down on the same tracks. That is, it is irrelevant whether car 31*a* travels downwardly on rail 41 and passes car 30*a* as it travels upwardly, or vice versa. In addition, the transition section can be considerably shorter, requiring only twice the vertical distance necessary for a car to traverse sideways from one hoistway to another at the desired lateral (horizontal) acceleration and deceleration. Thus, at a horizontal acceleration/deceleration of 0.3 meters per second per second, a lateral traverse of 3.4 meters would require 2.13 seconds, which means each car would travel 21.3 meters vertically. Therefore, the total transition section requires about 43 meters for lateral transition, plus another few meters on each end to ensure that the LEM is fully engaged before retracting the coupler.

Figure 31:
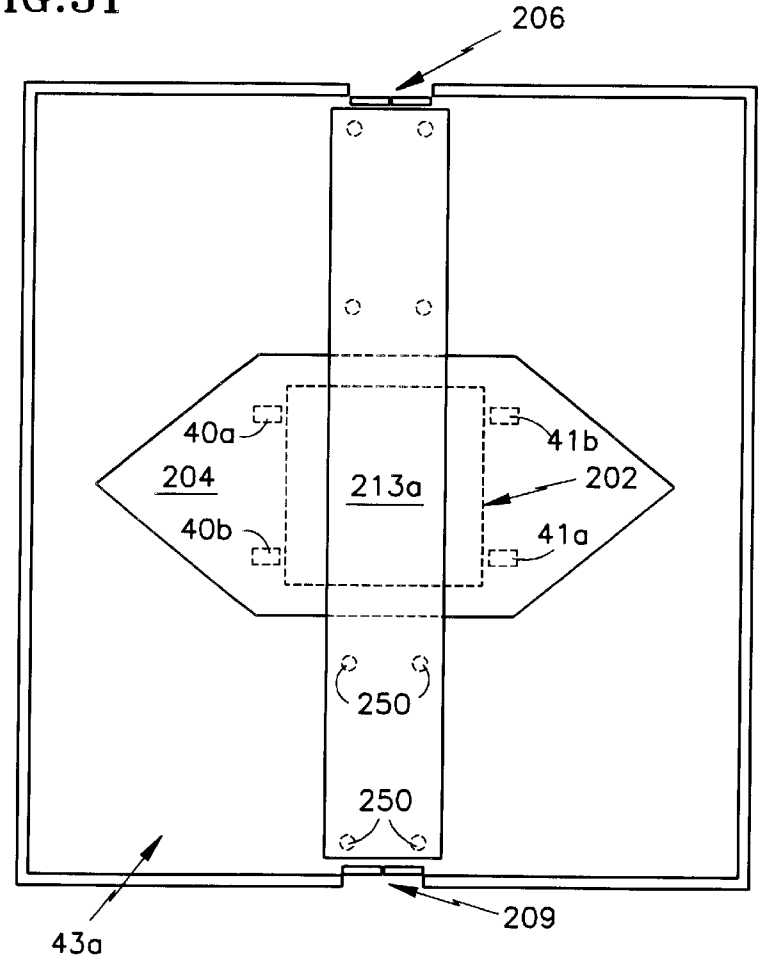
FIG. 31 is a simplified plan view of an upper passenger landing for use with the embodiment of FIGS. 27–29.

Another advantage of the embodiment of FIGS. 27–29 is the simplification of the passenger landings. As seen in FIG. 31, the upper passenger landing 43*a* requires only a single track 213*a* and a pair of trolleys to permit delivering one car from the hoistway 202 to the lobby 206 at the same time another car is being delivered from the lobby 209 to the hoistway 202. If simultaneous delivery is not desired, then only one trolley is used.

Figure 32:
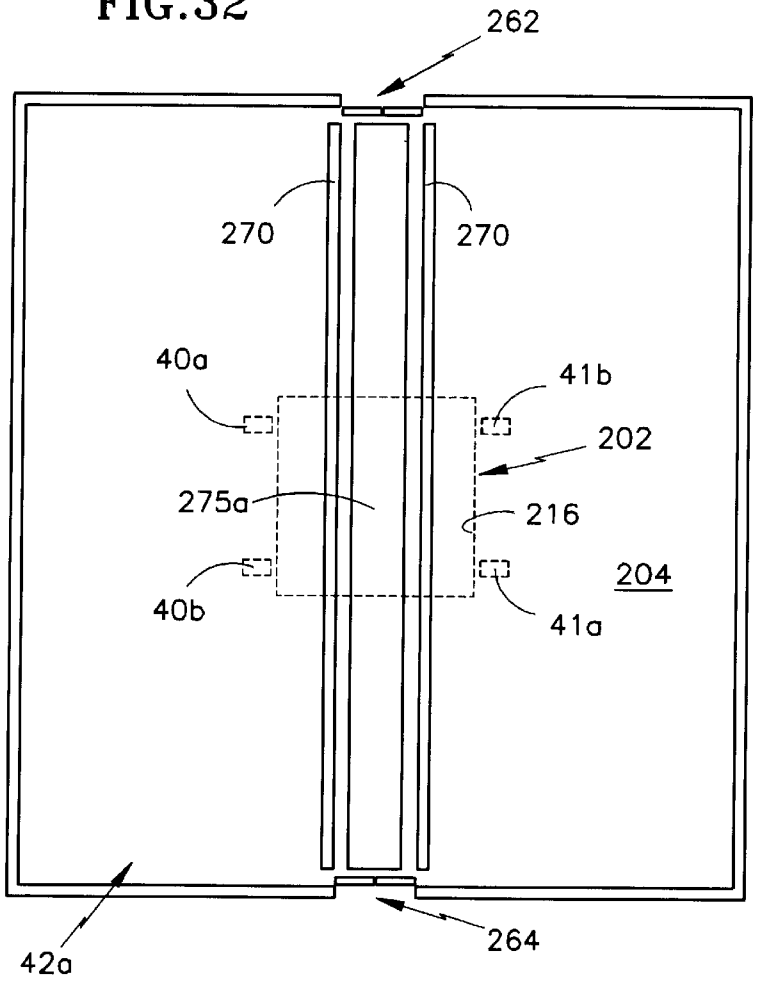
FIG. 32 is a top plan view of a lower passenger landing for use with the embodiment of FIGS. 27–29.

In this embodiment, a similar situation exists at the lower landing 42*a* (FIG. 32), requiring only one LEM primary 275*a* and a pair of tracks between the two lobbies 262, 264. In this embodiment, it is not necessary that the dollies be attached to the bottom of the cars, since there is no coupler getting between the car and the landing as the car is brought to the landing. Thus, a pair of dollies can remain at the lower landing 42*a* to serve either of the cars. As in the case of the upper landing, if simultaneous movement of cars to and from the hoistway is desired, two dollies will be required; otherwise, one dolly will suffice. Instead of a LEM transition section, a coupler driven by a traction machine (closed loop or not) may be used in conjunction with each set of rails. The roping requires guide sheaves to keep the ropes and couplers adjacent the related rails. The couplers could engage a complementary coupling means disposed in the center of the side of each car, in place of the LEM secondaries. Similarly, the hoistway couplers 32, 33 may be driven by LEMs on the couplers or on the counterweights, or both.

If desired, there could be one coupler in the center of each car and a pair of LEMs (or other transition apparatus) on the outside edges.

The invention may be used with multideck cars. All of the aforementioned copending applications are incorporated herein by reference.

Thus, although the invention has been shown and described with respect to exemplary embodiments thereof, it should be understood by those skilled in the art that the foregoing and various other changes, omissions and additions may be made therein and thereto, without departing from the spirit and scope of the invention.

We claim:

1. An elevator system for providing service between vertically remote landings of a building, comprising:

a plurality of vertically and horizontally adjacent hoistways disposed between said landings, each of said hoistways including a car coupler roped through a sheave to a counterweight, each for moving a car coupled thereto up and down in the corresponding hoistway, first coupled to a car heading up, and then coupled to a car heading down, to advance successive cars coupled thereto in alternate up and down directions in synchronism with the movement of cars coupled to the coupler in adjacent hoistways;

motive means for driving said couplers and said counterweights;

at least one transition section disposed between a pair of said hoistways, for providing vertical motion control to each of said cars to move said cars between the upper end of the lower hoistway and the lower end of the upper hoistway; and two pairs of guide rails, each pair extending between said landings, one of said pairs being on one side of said hoistways and said transition section and the other of said pair being on the other side of said hoistways and said transition section; and a plurality of elevator cars, each having guides for engaging said rails, each selectively engageable by said car couplers, said cars being engageable by the corresponding one of said transition means so as to be moved between the upper end of the lower one of said pair of hoistways and the lower end of the upper one of said pair of hoistways.

2. An elevator system according to claim 1 wherein said couplers comprise structure fitting beneath the cars.

3. An elevator system according to claim 2 wherein said couplers comprise fork-lift like structures; each tine being independently roped to a counterweight.

4. An elevator system according to claim 1 wherein said couplers comprise a plurality of elongated teeth facing the hoistway, said cars each having complementary elongated teeth facing the coupler.

5. An elevator system according to claim 1 wherein said motive means comprises traction machines driving said sheaves.

6. An elevator system according to claim 1 wherein said transition section comprises a linear electric motor system including a plurality of primary type portions and a plurality of secondary type portions, one of a first type of said portions being disposed adjacent a first pair of said rails, one of said first type portions being disposed adjacent a second pair of said rails, said first type of portions overlapping the upper end of the lower one of said pair of hoistways and overlapping the lower end of the upper one of said pair of hoistways, and one of a second type of said portions being disposed on each of said cars.

7. An elevator system according to claim 6 wherein said first type of portions comprise primary windings.

8. An elevator system according to claim 1 wherein the number of said vertically and horizontally adjacent hoistways is two.

* * * * *